US005117730A

United States Patent [19]

Yamauchi

[11] Patent Number: 5,117,730

[45] Date of Patent: Jun. 2, 1992

[54] STRING TYPE TONE SIGNAL CONTROLLING DEVICE

[75] Inventor: Akira Yamauchi, Hamamatsu, Japan

[73] Assignee: Yamaha Corporation, Hamamatsu, Japan

[21] Appl. No.: 554,021

[22] Filed: Jul. 17, 1990

[30] Foreign Application Priority Data

| | | | |
|---|---|---|---|
| Jul. 17, 1989 | [JP] | Japan | 1-184246 |
| Jul. 17, 1989 | [JP] | Japan | 1-184247 |
| Jul. 17, 1989 | [JP] | Japan | 1-184248 |
| Jul. 17, 1989 | [JP] | Japan | 1-184249 |
| Jul. 17, 1989 | [JP] | Japan | 1-184250 |
| Jul. 17, 1989 | [JP] | Japan | 1-184251 |

[51] Int. Cl.[5] ..... G10H 1/053; G10H 1/18

[52] U.S. Cl. ..... 84/723; 84/740; 84/742

[58] Field of Search ..... 84/723-742, 84/454, DIG. 18

[56] References Cited

U.S. PATENT DOCUMENTS

| | | | |
|---|---|---|---|
| 4,882,965 | 11/1989 | McClish | 84/726 |
| 4,884,486 | 12/1989 | McClish | 84/741 X |
| 4,966,052 | 10/1990 | Shiraki et al. | 84/723 X |

*Primary Examiner*—Stanley J. Witkowski
*Attorney, Agent, or Firm*—Graham & James

[57] ABSTRACT

A tone signal controlling apparatus for an electronic musical instrument comprising a body having a string corresponding portion, a movable performance member, and a sensor for detecting the action of the movable performance member with respect to the string corresponding portion, and generating a musical tone signal simulating a rubbed string instrument. The apparatus can control an electric signal simulating vibration of a string without any actual vibration of the string according the action of the movable performance member based on the output of the sensor, especially, by using signals representing a bow speed and a bow pressure which are applied to the string corresponding portion. Such special effects as vibrato can also be easily generated electrically. Owing to such electronic operability, the apparatus can also easily control the generation of the signal in accordance with a skill of a player.

9 Claims, 16 Drawing Sheets

CONVERTOR CHARA.

TIME-SHARING EXCITING

STRING TYPE TONE SIGNAL CONTROLLING DEVICE

BACKGROUND OF THE INVENTION a) Field of the Invention

This invention relates to an electronic musical instrument and more particularly to a tone signal controlling apparatus for use in an electrical musical instrument adapted to simulate a rubbed string instrument which is played by using a movable performance tool such as a bow.

b) Description of the Related Art

There are known such natural string instruments, which have strings to be rubbed by a bow, as violin, viola, cello, and double bass. There are also miniature versions of these instruments. Description will be made hereinbelow, mainly taking a voilin as a representative example.

The musical tone of the string instrument varies variously by the fingering, the bow speed, the bow pressure, etc. Generally, however, it requires much effort and exercise for a player to master the playing techniques of a string instrument.

Conventionally, such an electric violin was proposed which eliminated the resonating belly of the natural instrument violin, and retained the stretched strings of the natural instrument. The vibration of the strings was picked up by an electric pickup, and processed as an electric signal to generate sounds. For playing this conventional violin, similar performance as that of the natural instrument is done. The strings were rubbed or agitated by a bow to cause vibrations of the strings. Therefore, only skilled players can perform brilliantly the conventional electric violin.

SUMMARY OF THE INVENTION

An object of this invention is to provide a tone signal controlling apparatus which does not need to vibrate a string and can generate a musical tone of a rubbed string instrument.

Another object of this invention is to provide a tone signal controlling apparatus capable of being played in a similar manner as a natural rubbed string instrument.

Another object of this invention is to provide a tone signal controlling apparatus capable of easily generating musical tones of a rubbed string instrument even by a beginner player who has not yet exercised much.

Another object of this invention is to provide a tone signal controlling apparatus capable of designating a musical effect by simple operation, which effects can only be obtained by a considerable effort in the case of a natural musical instrument, and generating a musical tone varied in correspondence to such input.

Another object of this invention is to provide a tone signal controlling apparatus capable of adding support systems for the performance by various softwares, and of selecting a function in accordance with the level of the playing technique.

Another object of this invention is to provide a tone signal controlling apparatus capable of achieving performance without generating sounds to the outside, when desired, and also of generating musical tones of a rubbed musical instrument.

Another object of this invention is to provide a tone signal controlling apparatus capable of changing the musical tone in correspondence to a pressure applied to a string corresponding portion by a movable performance tool.

Another object of this invention is to provide a tone signal controlling apparatus for simulating a rubbed string instrument which can sufficiently respond to the performance of a player who has the playing technique of a high grade.

Another object of this invention is to provide a tone signal controlling apparatus which can select a featuring performance support function of some kind in accordance with the level of the playing technique.

Another object of this invention is to provide a tone signal controlling apparatus comprising a body having a string corresponding portion; a movable performance tool to be held by a player and to be moved in faced relation to the string corresponding portion to achieve performance, capable of inputting a pressure which should be applied to the string corresponding portion by the movable performance tool, by a simpler method and of generating a musical tone varying in correspondence to such input.

Another object of this invention is to provide a tone signal controlling apparatus which can selectively respond to a holding pressure given to a handle portion of a movable performance tool, to change the musical tone.

Another object of this invention is to provide a tone signal controlling apparatus for an electronic rubbed string instrument which does not really have a string, which can easily change the pitch of a musical tone to be generated.

Another object of this invention is to provide a tone signal controlling apparatus for an electronic rubbed string instrument which can independently and arbitrarily change the pitch of respective strings.

Another object of this invention is to provide a tone signal controlling apparatus for an electronic rubbed string instrument, which can change the pitches of respective strings in a predetermined pattern simultaneously.

According to an aspect of this invention, a body having a string corresponding portion and a movable performance tool corresponding to a bow are used. If the performance mode in which a bow rubs a string to cause it to vibrate as in a natural rubbed string instrument is adopted, it requires much exercise for a player to obtain playing techniques of a considerable grade. Movement of a movable performance tool such as a bow with respect to a body of the instrument is detected to form performance parameters necessary for generating tone signals of a rubbed string instrument. Thus, musical tones of a rubbed string instrument can be generated without causing a string to vibrate.

The musical tone of a rubbed string instrument is generated through vibrations of strings. Featuring elements of determining the vibration of a string is the mutual movement of a bow rubbing a string with respect to the string, as well as the length of the string portion which determines the pitch. The mutual movement determines a bow speed, a bow pressure, etc. When performance parameters are formed by detecting the mutual movement of the movable performance tool such as a bow with respect to a string corresponding portion of the body, basis musical tone formation of a rubbed string instrument can be done. When a velocity is detected as a mutual movement, the effects of the bow speed in a rubbed string instrument can be simulated.

When an engage position of the movable performance tool with respect to a string corresponding portion is detected as a mutual movement, the effect of the bow position of a rubbed string instrument can be simulated.

When pressure is detected as a mutual movement, the effect of the bow pressure in a rubbed string instrument can be simulated. For example, a pressure sensor may be disposed in a string corresponding portion. When a movable performance tool is contacted to the string corresponding portion to apply a force, a bow pressure signal can be obtained.

In this way, by using a body having a string corresponding portion and a movable performance tool such as a bow, and by converting the mutual movement of the movable performance tool with respect to the string corresponding portion into a detection signal of the mutual movement, elements of the musical tone as a tone of a rubbed string instrument can be controlled.

There exist special effects of the violin, which include pizzicato, tremolo, col legno, sul ponticello, sur tasto, etc.

In an electronic musical instrument, various musical effect can be added to musical tone by utilizing the advantage of the electronic musical instrument and processing the electric signal, etc. These processings can be designated by simply operating a switch or switches.

It is possible even for a beginner player to add a certain musical effect easily, without accompanying technical difficulty which would be accompanied in the case of a natural musical instrument.

It is difficult for a beginner player of the violin to precisely control the pressure of a movable performance tool applied to a string corresponding portion. By providing a pressure sensor in a handle portion of a movable performance tool which can be handled more easily and using a grasping pressure as a parameter for forming a musical tone such a bow pressure, etc., control of the musical tone of a rubbed string instrument is made easily.

It is difficult for a beginner player of the violin to precisely control fingering, the pressure given by a bow to a string etc. Especially, in modifying performance on a fingerboard, and in the performance using the top bow where the handle portion of the bow and the string rubbing portion is departed, it is difficult to minutely control the bow pressure.

By providing a performance mode selection means in a handle portion of a movable performance tool where control is easier, and by inputting a parameter or parameters for defining a musical tone for a special effect, control of the musical tone of a rubbed string instrument is made easy.

An electrical musical instrument can generate musical tone of a constant pitch without performing adjustment of the string corresponding portion. In an electrical musical instrument, however, it may be necessary to change all the scales of the strings for disposition, or to alter scales of part of the strings according to the piece to be played. Since the pitch of an electronic musical instrument will never be fluctuated, it is not necessary to effect adjustment of the strings to bring the scales to the original pitches. However, it is preferable that the scale adjustment can be done for transposition. By utilizing the features of an electronic musical instrument, it is possible to arbitrarily designate the pitches of the strings by simple operation. It is also possible to effect a predetermined tuning by one touch action. Independent tuning of the respective strings is also possible. Here, by providing a reset switch, it is also possible to return the tuning state a predetermined standard condition by one touch action.

BRIEF DESCRIPTION OF THE DRAWINGS

FIGS. 1A to 1C show a structure of an electronic circuit of an electronic musical instrument according to an embodiment of this invention, wherein FIG. 1A is a block diagram of a schematic general structure, FIG. 1B is a block diagram of a basis structure of a tone signal generating circuit, and FIG. 1C is a graph showing and example of a non-linear function.

FIGS. 2A to 2C show exterior views of an electronic bowed musical instrument according to an embodiment of this invention, wherein FIG. 2A is a side view of a main body of the bowed musical instrument, FIG. 2B is a front view of a main body of the bowed musical instrument, and FIG. 2C is a side view of a bow.

FIGS. 3A and 3B show a neck of the instrument, wherein FIG. 3A is a longitudinal cross section of the neck, and FIG. 3B is a transverse cross section of the neck.

FIGS. 4A to 4C illustrate a pitch designating structure provided in the neck, wherein FIG. 4A is a partial cross section of a fingerboard, FIG. 4B is a circuit diagram of a first diagram construction and FIG. 4C is a circuit diagram of a second circuit construction.

FIGS. 5A to 5C illustrate a vibrato switch, wherein FIG. 5A is a partial cross section of the neck portion, FIG. 5B is a circuit diagram of a first circuit construction, and FIG. 5C is a circuit diagram of a second circuit construction.

FIGS. 6A to 6D illustrate performance by a bow, wherein FIG. 6A is a schematic diagram illustrating the mutual relation of a bow and a bridge, and FIGS. 6B, 6C and 6D are diagrams for illustrating three modes of detecting the mutual motion of the bow with respect to the main body of the instrument.

FIGS. 7A and 7D illustrate a bow, wherein FIG. 7A is an exterior view of a bow seen from the string rubbing surface, FIG. 7D is a transverse cross section of a modification of a slide plate.

FIGS. 8A and 8B illustrate a string corresponding portion to be rubbed by a bow, wherein FIG. 8A is an exterior view of a rubbed string portion, and FIG. 8B is a cross section of a light receiving portion.

FIGS. 9A to 9C illustrate a bow speed detection circuit, wherein FIG. 9A is a block diagram of the bow speed detection circuit, FIG. 9B shows waveforms for illustrating the operation of the circuit, FIG. 9C is a diagram showing relation of the input and the output of a converter circuit.

FIG. 11B is a block diagram of a former stage of a light pulse detection circuit, and FIG. 11C is a block diagram of a latter stage of the light pulse detection circuit.

FIGS. 13A and 13B illustrate a bow pressure detection device, wherein FIG. 13A is a block diagram of a string corresponding portion, and FIG. 13B is a block diagram of a bow pressure signal circuit.

DESCRIPTION OF THE PREFERRED EMBODIMENTS

Figure 1A:
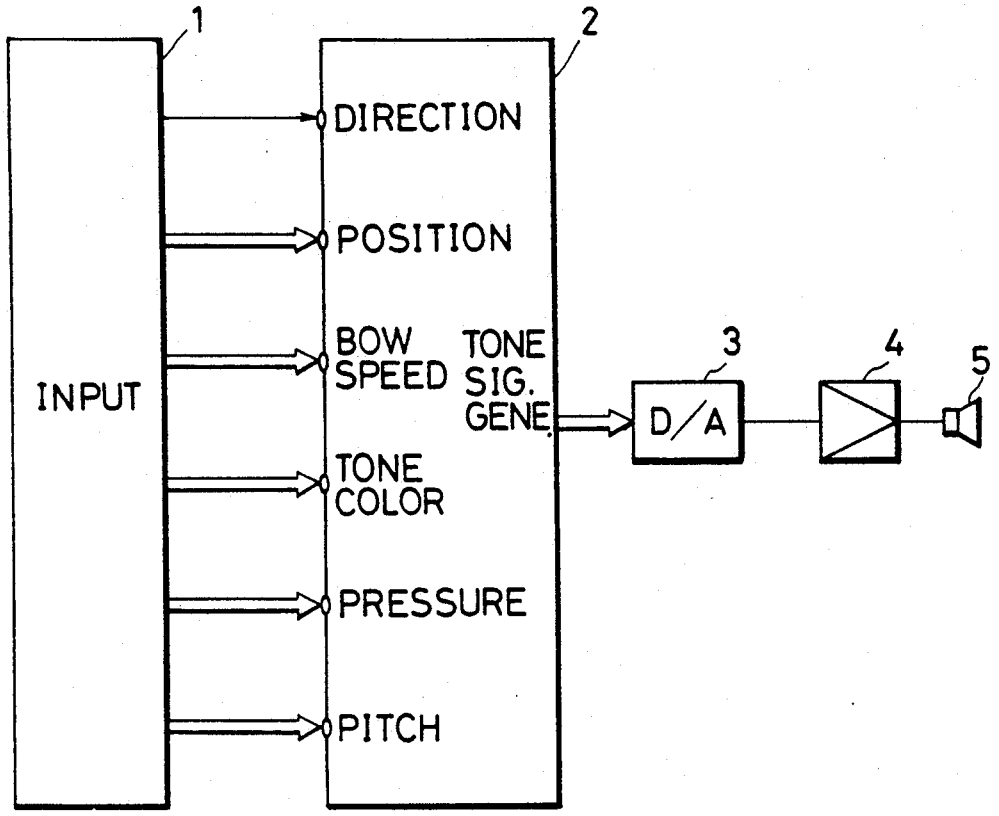
Figure 1B:
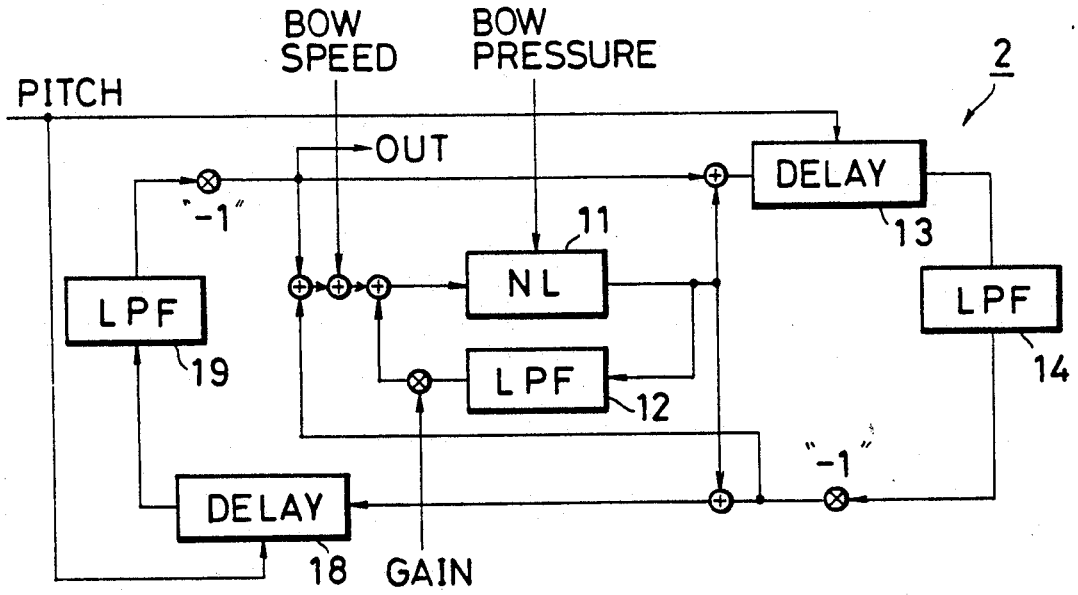

FIGS. 1A and 1B show a basic structure of an electronic circuit of an electronic rubbed or bowed string instrument wherein a bow corresponding member is brought into contact with a string corresponding member for generating a tone signal. FIG. 1A shows a schematic structure of the whole system. In an input device 1, performance parameters can be inputted by various operations of a player.

Typically, performance is done by organically coupling a movable performance tool such as a bow with a main body of the musical instrument, for example bringning a bow in contact with a string corresponding portion, and mutually moving the movable performance tool. As typical examples of various performance parameters, direction of the movement of a bow, position of a bow where contact is formed with a string, such as top bow, bottom, bow, etc., bow speed, bow pressure which is applied to a string, pitch (tone pitch) designated in a fingerboard, and the tone color are shown to be generated from the input device 1. Besides these parameters, there can also be provided such parameters as the position of a string where a bow is contacting, the angle of a bow with respect to a string, etc.

A tone signal generating circuit 2 generates a tone signal based on these performance parameters. This tone signal is a digital signal, is converted into an analog signal in a D/A converter 3, and is sounded as a musical tone in a loud speaker 5 through an amplifier 4. Musical tones simulating those of a natural rubbed string instrument can be generated based on the controlled parameters unique to the rubbed string instrument as described above.

FIG. 1B shows an example of a basic construction of a main part of the tone signal generating circuit 2 shown in FIG. 1A.

This is a nonlinear tone signal generating circuit which is modeled after a rubbed string instrument, and is constituted by a nonlinear function circuit NL 11 simulating the frictional characteristic between a string and a bow, delay circuits 13 and 14 simulating the characteristics of a string, and low pass filters (LPF) 12, 14 and 19. In the example of FIG. 1B, a non linear characteristic portion is constituted with a nonlinear circuit 11 and a low pass filter 12. The output of the nonlinear circuit 11 is applied to a loop circuit representing a string at two positions representing the same bow contact point. A string is considered to have two parts, a part on the bridge side from the rubbed position and another part on the peg side from the rubbed position. The characteristics of a string is simulated by two circuit portions corresonding to these two parts, each having a delay circuit and a low pass filter. The delay circuit 13 and the low pass filter 14 simulate the characteristics of the bridge side string, and the delay circuit 18 and the low pass filter 19 simulate the characteristics of the peg side string. Of course it is possible to exchange the characteristics of these parts to simulates the peg side string with the circuits 13 and 14 and the bride side string with the circuit 18 and 19.

Figure 1C:
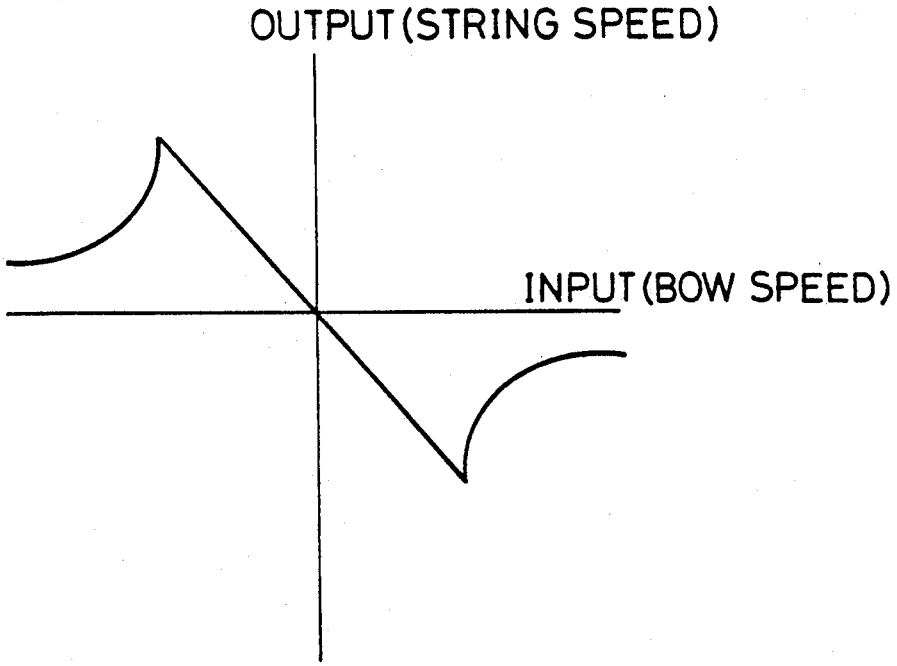

The nonlinear circuit 11 simulate the frictional characteristics between a string and a bow as has been described before, and provides input-output characteristics as shown in FIG. 1C, for example. In the figure, the abscissa represents the bow speed and the ordinate represents the string speed. The linear portion corresponds to the static friction. The frictional characteristics is determined by the bow pressure, etc. The maximum static friction force gives a large influence to the characteristics, and hence the nonlinear function is controlled in its magnitude and shape by the pressure of the bow.

Regarding the operation of the circuit of FIG. 1B, the output of the nonlinear circuit 11 which simulates the characteristics of a string in a rubbed string instrument is inputted to two circuitries of the loop circuit, shown on the lefthand and righthand sides in the figure, corresponding to the peg side string portion and the bridge side string portion. The circuit shown on the lefthand side, corresponding to the peg side string portion, includes the delay circuit 18 and the low pass filter 19. The output of this circuit is fed back to the nonlinear circuit 11, corresponding to the action of a vibration on the string which is reflected at the finger-pressed position on the fingerboard and returns to the rubbed position. Also, the bride side string portion shown on the right hand side, includes the delay circuit 13 and the low pass filter 14 and feeds back its output to the nonlinear circuit 11, corresponding to the action of the vibration on the string which is reflected by the bridge and returns to the rubbed position. Another low pass filter 12 is connected between the input and the output of the non linear circuit 11 to effect feedback of a controlled gain.

The pitch of a musical tone is determined by the delay time in the delay circuits 13 and 18, corresponding to the length of the string between the bridge and the fingered position on the fingerboard. Also, the speed and the pressure of a bow are inputted to the tone signal generating circuit as parameters for defining the characteristics of the tone signal. For example, the bow speed changes the tone color (harmonics structure), and bow pressure changes the tone volume and the tone color, etc. Also, the direction of the bow movement, the position of the bow and other information may control the characteristics of the musical tone to be generated.

In this way, the circuit of FIG. 1B simulates a musical tone due to the vibration of a string in a rubbed string instrument. The output of the circuit of FIG. 1B is passed through a further filter circuit (not shown), etc. and supplied to D/A converter 3 of FIG. 1A.

Figure 2A:
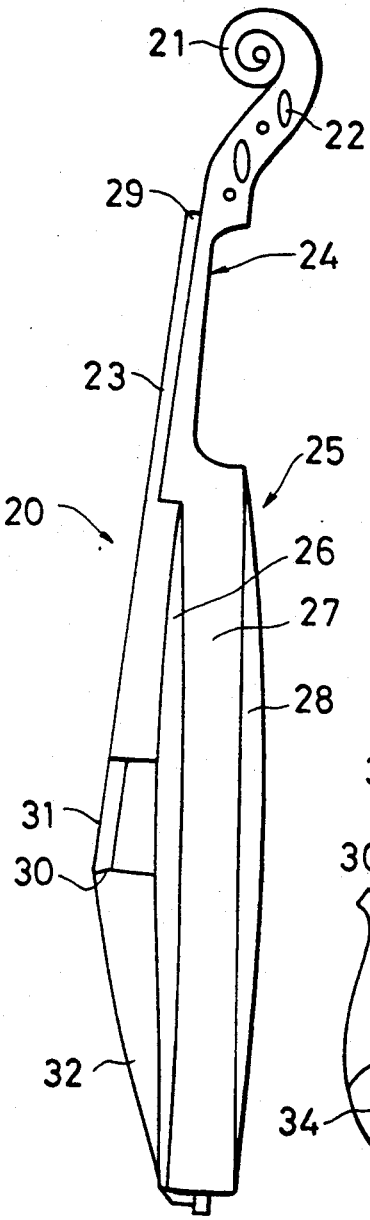
Figure 2B:
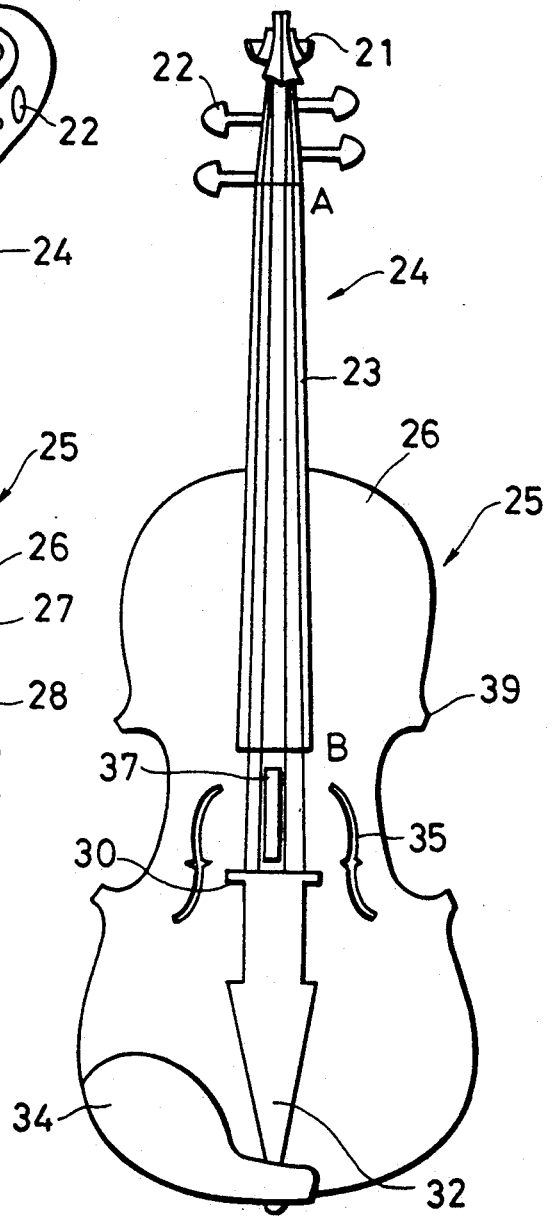
Figure 2C:
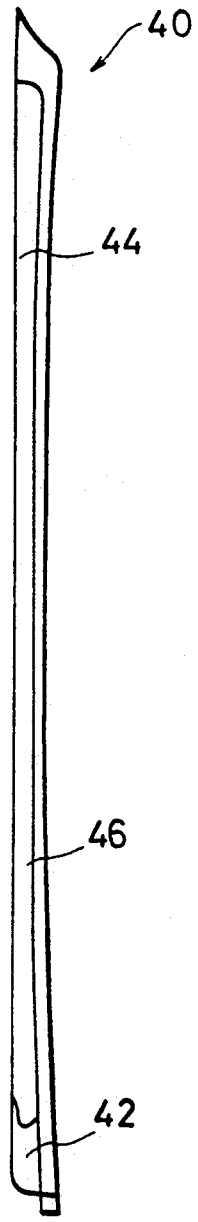

FIGS. 2A to 2C show exterior views of an electronic musical instrument according to an embodiment of this invention. FIG. 2A shows a side view of a main body of the instrument and FIG. 2B shows a front view of the main body of the musical instrument.

The main body has an exterior shape mostly similar to that of a natural string instrument violin, but may have a simplified structure in various portions since there is no need to actually vibrate a string nor cause resonance in the belly. A neck 24 extends upwards and continues to a peg portion 22 and to a scroll 21. A fingerboard 23 is provided on the front side of the neck 24. When a player presses a finger on the fingerboard, a pitch signal which determines the tone pitch is generated. Similar to the natural musical instrument violin, a nut 29 and a bridge 30 are formed at positions between which strings are supposed to be stretched. A string rubbing portion 31 is formed near the bridge 30 for establishing a region where performance by a bow is to be done. Below the bridge 30, a tail piece 32 is provided. A front plate 26, a side plate 27 and a back plate 28 constitute a belly 25 which would form a resonating structure in the case of a natural musical instrument. In the belly 25, corners 39 and "f" holes 35 are formed similar to the natural musical instrument. Further, a chin rest 34 is formed at the portion where the chin of a player will be rested. Here, the portions related with the strings and the resonator may be arbitrarily altered or dispensed with.

In this way, the body of the rubbed string instrument is formed to have substantially the same configuration as the natural rubbed string musical instrument, but there are no actual strings stretched. In the string rubbing portion 31, friction members corresponding to the strings are provided. In the neighborhood of this string corresponding portion 31, detection means 37 for detecting the mutual movement, which is formed of light receiving means, light emitting means, light reflecting means, etc. is provided to detect the mutual movement of the bow. FIG. 2C shows a bow. The bow 40 has a top portion 44, a bottom portion 46, a handle portion 42, etc. The portion where hairs are stretched in the case of a natural musical instrument has no actual hairs, but has a corresponding shaped formed of plastic or the like.

Figure 3A:
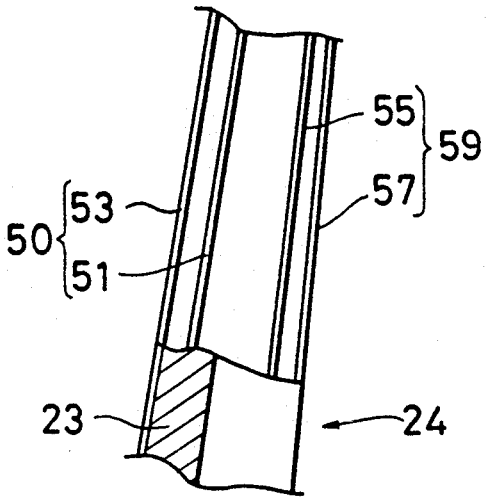
Figure 3B:
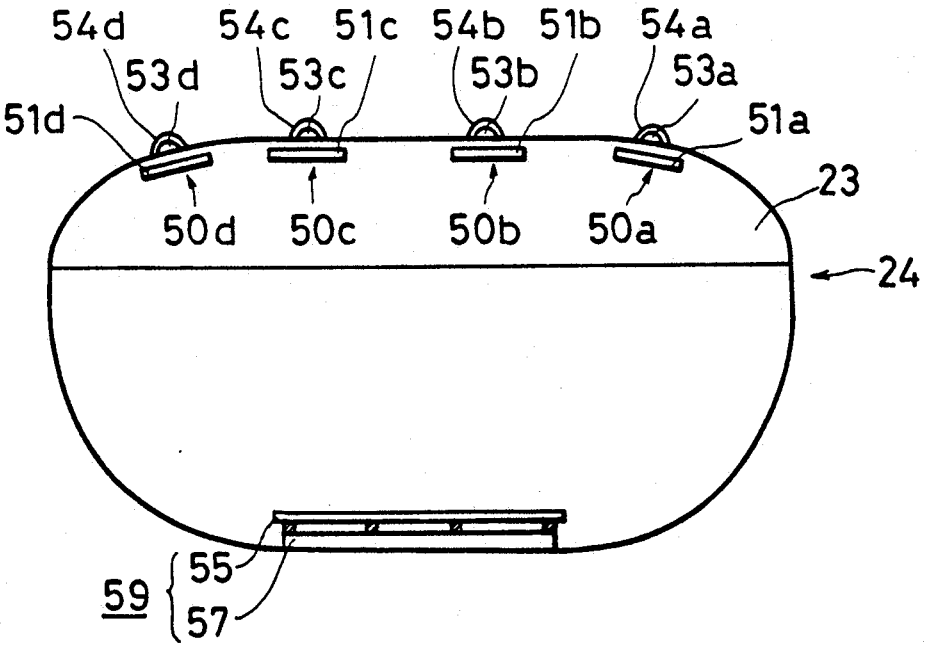
Figure 4A:
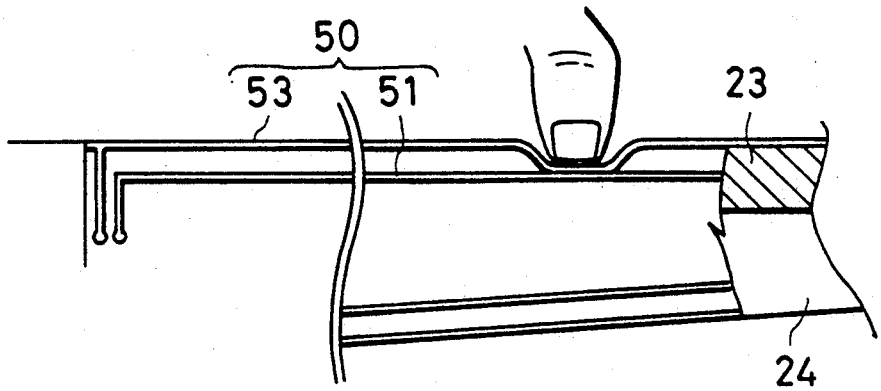

FIGS. 3A and 3B show an inside structure of the neck. FIG. 3A is a longitudinal cross section and FIG. 3B is a transverse cross section. In the natural violin instrument, four strings are stretched above the fingerboard disposed on the front side of the neck. In this embodiment, however, pitch designating means 50 corresponding to a string is provided. Namely, four pairs, each formed of a resistance wire element 51 embedded in the fingerboard 23 and a conductive wire element 53 disposed thereon, are provided as shown in FIGS. 3A and 3B. When the conductive wire element 53 is depressed, the conductive wire element 53 is allowed to be deformed as is shown in FIG. 4A and makes a contact with the resistance wire element 51. The pitch designating action will be further described later.

On the back side of the neck 24, a vibrato switch 59 having a fixed contact member 55 and a movable contact member 57 is disposed.

FIG. 3B shows the inside structure of the neck in a transverse cross section. Four pairs of pitch designating means 50*a*, 50*b*, 50*c*, and 50*d* are disposed in parallel to each other on the fingerboard 23, each pair having a resistance wire element 51*a*, 51*b*, 51*c*, or 51*d* and a conductive wire 53*a*, 53*b*, 53*c*, or 53*d*. Further, insulating member 54*a*, 54*b*, 54*c*, and 54*d* are provided to cover the conductive wire elements 53*a*, 53*b*, 53*c*, and 53*d*. The vibrato switch 59 formed on the lower side of the neck 24 is constructed as a longitudinally elongated switch which has as enough width to enable manipulation of the vibrato switch by a thumb whenever the player presses his finger on any position of any string. Here, the gaps between the resistance wire element 51 and the conductive wire element 53 in the pitch designating means 50 and between movable contact member 57 and the fixed contact member 55 in the vibrato switch 59 are fundamentally formed of vacant spaces. For supporting the structure in the open state, insulating spacer member may be inserted partially.

Figure 4B:
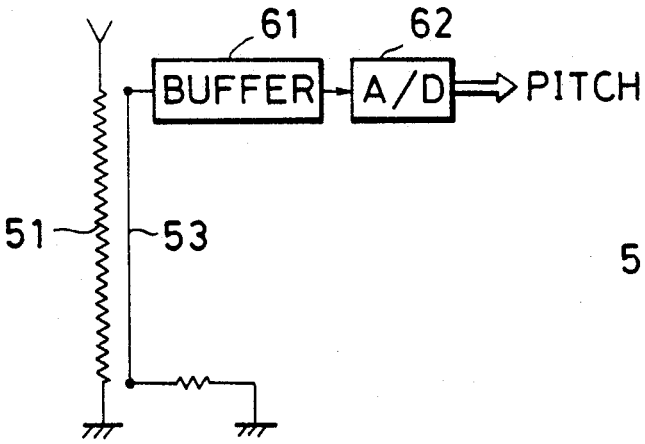
Figure 4C:
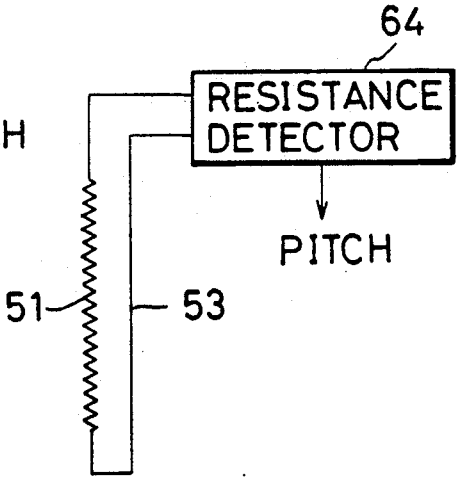

FIGS. 4A, 4B, and 4C show the pitch designating means 50 in more detail. In FIG. 4A, the player depresses a conductive wire 53 with his finger onto the fingerboard 23, thereby bringing the conductive wire element 53 into touch with the underlying resistance element 51, to derive a potential signal representing the contacted position.

The signal pickup circuit may be formed, for example, as shown in FIG. 4B or in FIG. 4C. In FIG. 4B, the resistance wire element 51 is connected between a predetermined potential and the ground potential to establish a potential distribution along the element which varies depending on the position. When the conductive wire element 53 touches the resistance wire element 51, the potential at the contacted position on the resistance wire 51 is derived through a buffer circuit 61 and an analog/digital (A/D) converter circuit 62, to generate a pitch signal.

FIG. 4C shows another configuration. The resistance wire element 51 and the conductive wire element 53 are aligned in parallel, connected in series and connected to a resistance detection circuit 64. When the conductive wire element 53 is depressed to touch the resistance wire element 51, the portion of the resistance wire element 51 below the contact position is short-circuited, to determine the resistance by that portion of the resistance wire element 51 which is above the contacted position. In this way, the resistance is inputted to the resistance detection circuit 64, which decreases in accordance with to the contact position. Here, when the wire element 51 and the resistance element 53 are contacted at plural positions, the detection circuit 64 detects the nearest position. Also, a pitch signal based on this detected lowest resistance is generated.

Although two circuit configurations for forming a pitch signal from the finger depressed position in the string corresponding portion on the fingerboard are illustrated for examples, it is also possible to adopt other circuit configurations.

Figure 5A:
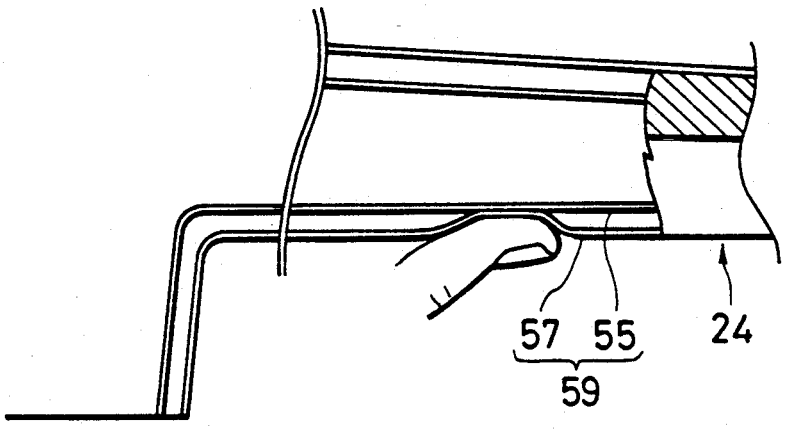
Figure 5B:
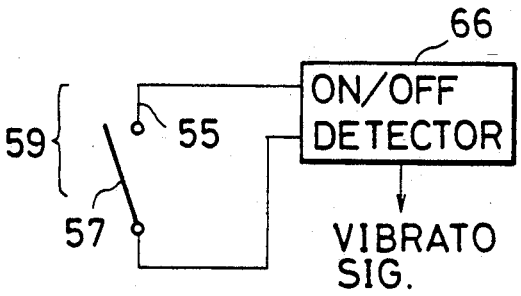
Figure 5C:
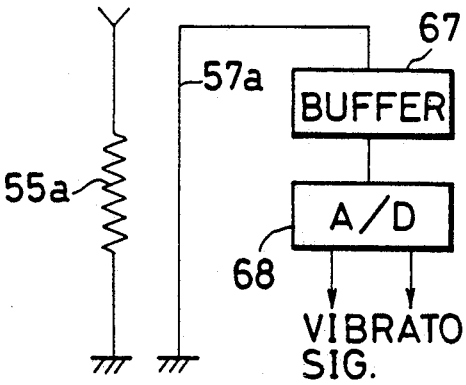

FIGS. 5A, 5B and 5C show examples of the structure of the vibrato switch 59. In FIG. 5A, when the lower surface of the neck 24 is depressed with a finger, a movable contact member 57, which constitutes a movable contact of a switch, contacts a fixed contact member 55. A vibrato signal is generated by detecting this contact state, to superpose vibrato effect on the generated tone signal.

FIG. 5B and 5C show two circuit configurations for detecting the contact between the fixed contact member 55 and the movable contact member 57. As shown in FIG. 5B, the fixed contact member 55 and the movable contact member 57 may be formed of conductors. When the movable contact member is pressed to touch the fixed contact member 55, the movable contact of an on/off switch is contacted to the fixed contact to close a circuit. An on/off dectection circuit 66 detects the on/off of the switch 59. A vibrato signal is generated based on the detection of on the state.

FIG. 5C shows a circuit for generating a signal representing the depressed position in the neck where a finger is depressed, in addition to the detection of on/off. The fixed contact member is formed of a resistive member 55*a*, and is applied with predetermined voltage between the two terminals. The movable contact member is formed of a conductive member 57*a*, and picks up the potential at a contact point of the resistive member 55*a* when the conductive member 57*a* is depressed to the resistive member 55*a*. The picked up potential at the contact point is derived through the buffer circuit 67 and the A/D converter 68 to generate an output signal. The output signal contains a signal component related with the on/off of the vibrato switch and a signal component representing which position of the vibrato switch is being depressed by a thumb.

For those players who have acquired the vibrato technique, the vibrato switch as described above may be rather hampering. Thus, the vibrato switch is constructed as arbitrarily releasable. In this case, a player may cut off the vibrato switch and can add the vibrato effect by vibrating the position of the finger on the fingerboard.

Figure 6A:
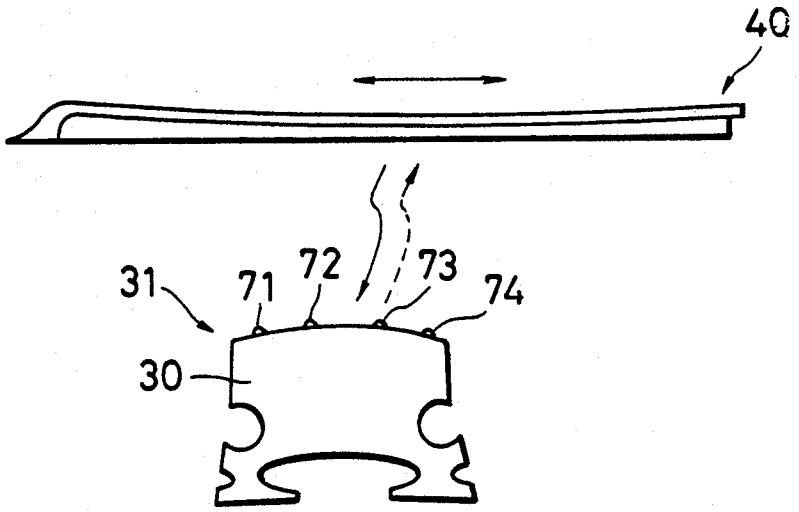

FIG. 6A schematically shows bow performance on a body. Performance is done by abutting a bow 40 to the string rubbing portion 31 disposed in the neighborhood of the bridge 30 on the body and passing the bow. The string rubbing portion 31 has four string corresponding members 71, 72, 73 and 74 corresponding to the four strings of the natural musical instrument. A player abuts the bow 40 to either one of these string corresponding members, bringing into contact state, to effect performance. Here, parameters which determines the musical tone to be generated include the moving speed, the moving direction, the contact position, the pressure etc. of the bow 40. For obtaining these informations, signal generating means and signal detection means are provided in the bow 40 or in the string rubbing portion 31, to detect the relative movement of the bow. Here, the word "movement" is used to include the pressure or the force.

There are many ways of detecting the relative movement of the bow 40 with respect to the main body of the instrument.

One of the methods is to dispose some member which combines the main body of the instrument and the bow electrically, to form a resonance circuit, etc. The mutual inductance or the mutual capacitance between the bow and the main body of the instrument may be utilized. A signal corresponding to the degree of the coupling between the bow and the main body can be derived, to enable to detection of the mutual movement. Here, however, when the coupling between a single pair of members is utilized, the area of region where detection is possible may be narrow or the detection accuracy may be low.

Another of the detection methods is to provide plural elements on a moving bow and selectively couple them with an element on the main body of the instrument.

Figure 6B:
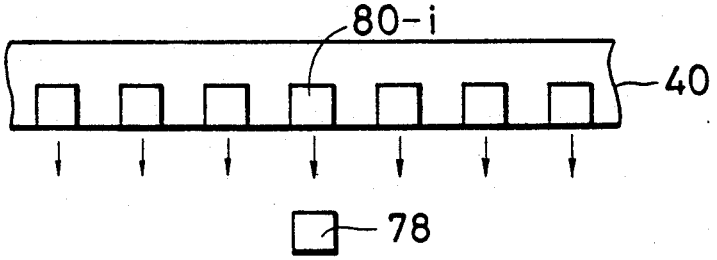
Figure 6C:
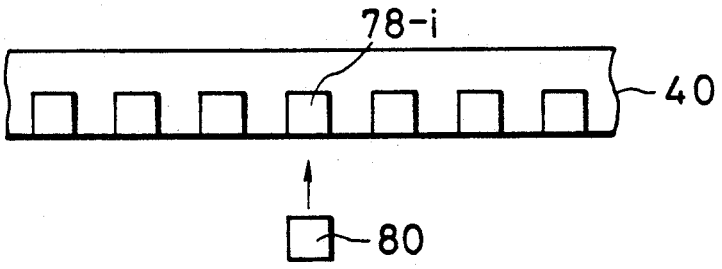
Figure 6D:
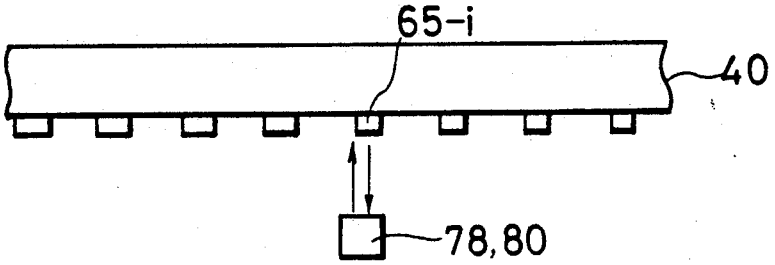

FIGS. 6B, 6C and 6D show an example of this method.

In FIG. 6B, a plurality of light emitting elements 80-*i* are aligned on the bow 40, and a light receiving element 78 is disposed on the main body of the instrument. Detection is made from which light emitting element, the light received by the light receiving element 78 comes, to discriminate what portion of the bow is abutting the string corresponding portion. Further, when measurement is done how many light pulses are injected in a unit time length, the moving speed of the bow 40 can be known.

FIG. 6C shows a case where a plurality of light emitting elements 78-*i* are disposed on the bow 40 to detect the light emitted from a light emitting element 78 disposed on the body. In FIG. 6C, operation is just the reverse of that of FIG. 6B and is dispensed with here.

These signal transmissions may be done through ultra sonic waves, etc. as well as through light signals.

FIG. 6D shows an example where the light emitting element 80 and the light receiving element 78 are both disposed on the main body of the instrument and a plurality of reflecting patterns 65-*i* are formed on the bow 40. The light reflecting black and white patterns 65-*i* are disposed at a constant period, when the duty ratio or the ratio of widths of the black and white stripes changes with the position. Although the light reflecting pattern 65-*i* is shown to project from the surface of the bow, it may also be formed on a flat plane by printing black and white patterns. The light receiving element 78 and the light emitting element 80 are disposed in alignment along the direction perpendicular to the plane of the drawing.

A light beam is emitted from the light emitting element 80 on the main body of the instrument onto the light reflecting patterns 65-*i* on the bow 40, and the reflected light is detected in the light receiving element 78. When the number of pulses in the light detection signal is counted in the unit time length, the bow speed can be measured. When the ratio of high level period to the low level period in the light reception signal is detected, the position of the contact of the bow 40 to a string corresponding member can be detected. A bar code may be formed with black and white pattern to represent a position information. Further, the light emitting element and the light receiving element may be disposed on the bow and a light reflecting pattern may be disposed on the main body, on the contrary to the case of FIG. 6D.

Figure 7A:
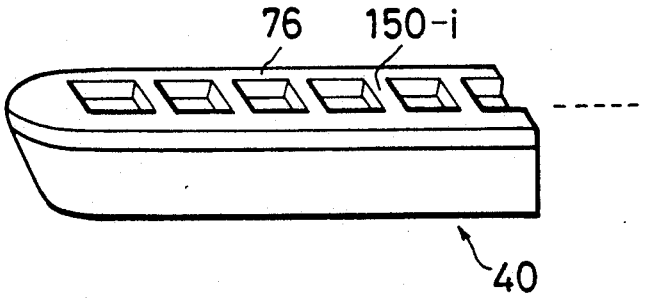
Figure 7B:
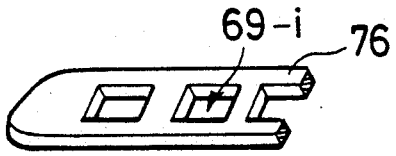
FIG. 7B is a perspective view of a slide plate.
Figure 7C:
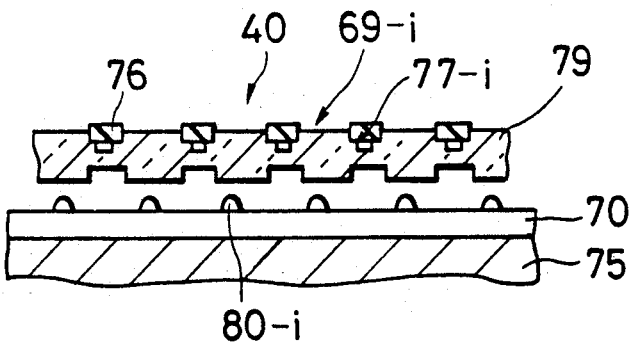
FIG. 7C is a longitudinal cross section of the bow.
Figure 7D:
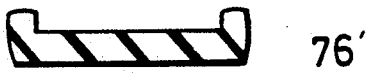

FIGS. 7A and 7D show examples of the structure of the bow of a type shown in FIG. 6B or 6C, where a plurality of photoelectric elements are disposed on the bow.

FIG. 7A is an exterior view of the bow 40 when seen from the string rubbing or sliding surface. A sliding plate 76 is disposed on the lower surface of the bow 40 which constitutes a string rubbing surface. The sliding plate 76 corresponds to hair of the bow of the natural instrument and may be formed of a material of an appropriate sliding touch, for example plastic.

FIG. 7B is a perspective view of only the sliding plate 76. There are formed a plurality of windows 69-*i* in the sliding plate 76 for being exposed to a plurality of photoelectric elements 78-*i* or 80-*i*. The thickness of this sliding plate is desirably selected to have an appropriate thickness so that two or more photoelectric elements 80 (78) may not correspond to a single photoelectric element 78 (80), that is only one facing element 78 or 80 on the bow corresponds to the element on the body.

FIG. 7C is a longitudinal cross section of the bow 40. A printed circuitboard 70 is disposed on a support member 75 and a plurality of light emitting diodes 80-*i* are disposed on the printed circuitboard 70. A light conducting member 79 is disposed on the bow 40. Lens portions of the light conducting member 79 are positioned to correspond to the light emitting diodes 80-*i*. On the upper surface of the light conductive member 79, a plurality of recesses 77-*i* are formed, to form guiding groves for the sliding plate 76. Namely, lights emitted from the respective light emitting diodes 80-*i* pass through associated lens portions of the light conducting member 79 and are emitted as separated light rays from windows 69-*i* of the sliding plate 76.

The sliding plate 76 may also be shaped as shown in FIG. 7D. The sliding plate 76' have projecting sides. By such configuration, the contact surface area is decreased to decrease the friction, and improve slidability.

Although description is made on a bow 40, in which a plurality of light emitting diodes are distributed, a plurality of light receiving element instead of a plurality of light emitting diodes may be distributed as shown in FIG. 6C. The light receiving element may be photo diodes or phototransistors. Further, in correspondence to respective windows 69-*i*, pairs of a light emitting element and a light receiving element may be disposed on the bow, wherein the light is reflected at the string rubbing portion. Also, combination of a magnet and coil may be used to utilize a magnetic field instead of light. Further, instead of the signal transmission by light, proximity switches utilizing capacitance or utilizing variation in the capacitance or the inductance or those utilizing the ultrasonic wave as the signal transmitting medium may be employed as described before. Further, any methods can be adopted which can detect the relative movement of the bow 40.

Figure 8A:
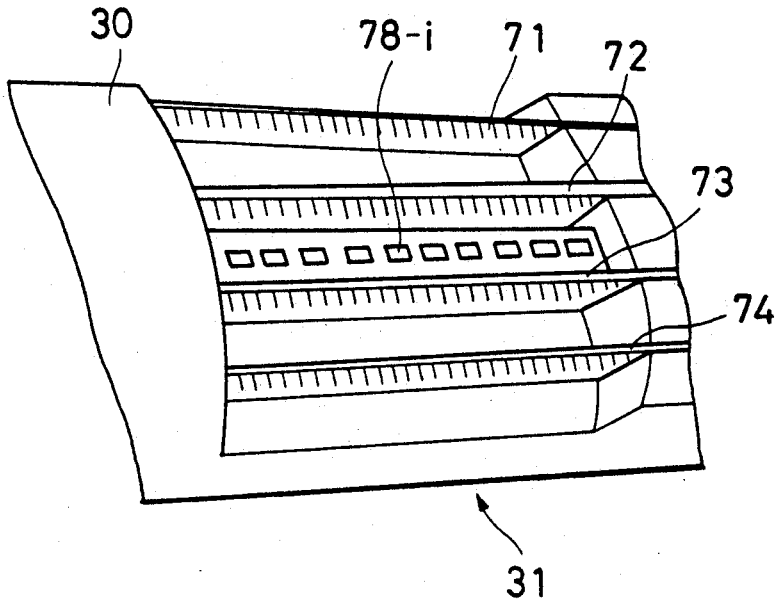
Figure 8B:
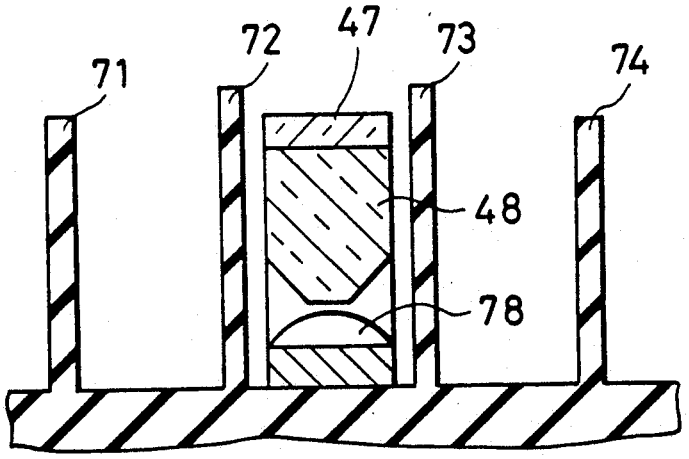

FIGS. 8A and 8B show and example of the structure of a string rubbing portions 31 which is formed near the bridge on the main body of the musical instrument.

FIG. 8A is a perspective view of the string rubbing portion 31 near the bridge 30. String corresponding members 71, 72, 73 and 74 are provided just above the bridge 30, with a train of light receiving members 71*i* disposed between the string corresponding members 72 and 73.

FIG. 8B is a cross section showing the structure of the light receiving portion. The light receiving elements 78 are embedded between the string corresponding members 72 and 73. An infrared (IR) filter 47 is disposed above the light receiving elements 78, to transmit only the infrared rays of a certain wavelength range. A light conducting member 48 formed of a transparent acrylic resin. etc. conducts the infrared rays of the certain wavelength range which has passed through the IR filter 47 further below. A light receiving element 48 is disposed at such a position at which the infrared ray emitted from the light emitting surface of the light conducting member 48 impinges on. A plurality of such light receiving structures are aligned along the string corresponding members 72 and 73, as shown in FIG. 8A. One set of light receiving elements is provided for the four strings. For example, when the bow 40 rubs the string 71 or 74 disposed at the outermost position, the lights emitted from the bow 40 can be detected by the centrally disposed light receiving elements 78. Of course, four sets of light receiving elements may be provided corresponding to the respective strings.

Even a single light receiving element can detect the bow speed and the bow position. In such a case, for detecting the light with high reliability, the light receiving element is preferably formed elongated along the string corresponding member. When a plurality of light receiving elements are disposed along string corresponding member as shown in FIG. 8A, it can also be detected which portion of the string is rubbed by the bow. For the performance of a player having a high level of technique, the element of the musical tone such as tone color may further be controlled depending on the position of the string where the bow contacts. Also, for the performance of a player who has not exercised much, even if the posture of the bow is not correctly set, any of the light receiving elements may detect the light emitted from the bow 40 and generate a tone signal. Further, by detecting the posture of the bow 40, the monitor result may be fed back to the player through a display.

Figure 9A:
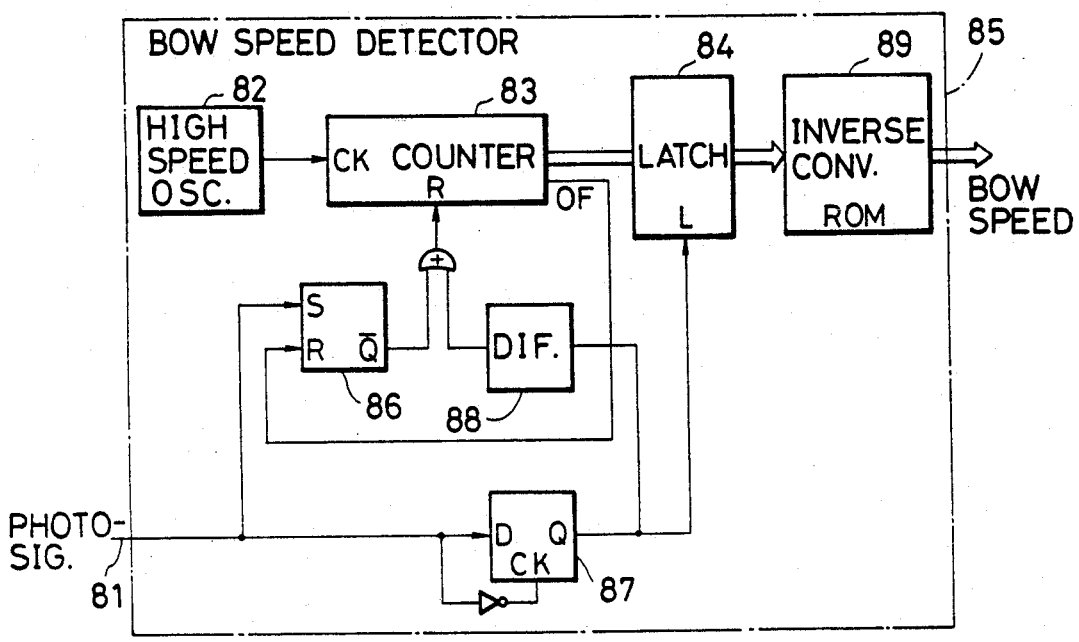
Figure 9B:
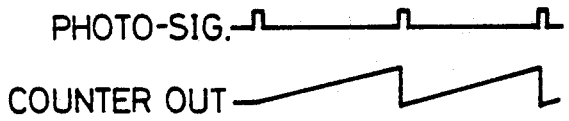
Figure 9C:
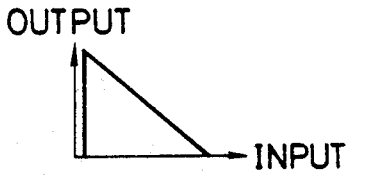

FIGS. 9A, 9B and 9C show a bow speed detection circuit. In FIG. 9A, a bow speed detection circuit 85 receives at its input terminal a light reception signal 81 which is formed by receiving the light emitted from the bow 40 having a plurality of light emitting elements 80-*i* as shown in FIG. 6B, with the light receiving elements 78-*i* as shown in FIGS. 8A and 8B. A counter 83 counts high speed pulses supplied from a high speed oscillator 82 and supplies the count to a latch 84. The light reception (photo) signal 81 is sent to flip-flops 86 and 87. The output fo the flip-flop 87 is differentiated in a differential circuit 88. An AND logic of the outputs of the flip-flop 86 and the differential circuit 88 is taken in an AND circuit and is supplied to reset R input of the counter 83. Therefore, the counter 83 is reset at each light reception signal pulse, to renew the count. Further, the outputs of the flip-flop 87 is also supplied to the latch 84. Thus, the number of counted pulses between light reception signal pulses is outputted from the latch 84. The number of counted pulses increases as the bow is moved slowly. The output of the latch 84 is sent to an inverse converter circuit 89 which generates a bow speed signal.

FIG. 9B is a waveform diagram for illustrating the operation of the circuit shown in FIG. 9A. Let us consider a case where the bow is moved at a constant speed. Pulse-like photo signals 81 of a constant interval are supplied from the light receiving elements. In the duration between adjacent pulses of the light reception photo signals 81, the counter 83 counts the high speed pulses supplied from the high speed oscillator 82, to increase the count. When the next light reception signal pulse is inputted, the counter 83 is reset, and the maximum value of the counter output is stored in the latch 84. As the moving speed of the bow is higher, the interval between adjacent light reception signal pulses becomes shorter, and the counter output to be latched becomes smaller. As the moving speed of the bow becomes lower, the interval between adjacent light reception signal pulses becomes longer, and the counter output to be latched becomes larger. In this way, the moving speed of the bow 40 and the counter output to be latched are in an inversely proportional relation.

FIG. 9C shows an input vs. output characteristics of an inverse converter circuit which performs such conversion. The inverse conversion circuit 89 produces the signal representing the moving speed of the bow from the counter output and supplies it as the bow speed signal.

Figure 10:
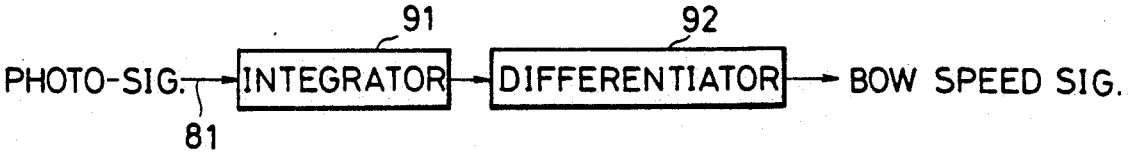
FIG. 10 is a block diagram showing another example of the bow speed detection circuit.

FIG. 10 shows another example of the bow speed detection circuit. The light reception signal 81 which is formed by detecting the lights emitted from the bow having a plurality of light emitting elements with a light receiving element disposed on the main body is supplied to an integral circuit 91. The integral circuit 91 integrates the input signal and generates an output corresponding to the number of pulses. Namely, as the bow 40 moves faster, more pulses are inputted correspondingly and the output of the integral circuit 91 increases more rapidly. The output of the integral circuit 91 is supplied to a differential circuit 92. The differential circuit 92 differentiates the output of the integral circuit 91, to supply a bow speed signal corresponding to the rate of increase in the number of inputted pulses. Namely, as the bow moves faster, the number of pulses inuptting per unit time increases, the output of the integral circuit increases more rapidly, and the output of the differential circuit 92 becomes larger. On the contrary, when the bow moves slowly, the increase in the output of the integral circuit 91 becomes gentle, and the output of the differential circuit 92 becomes smaller.

Figure 11A:
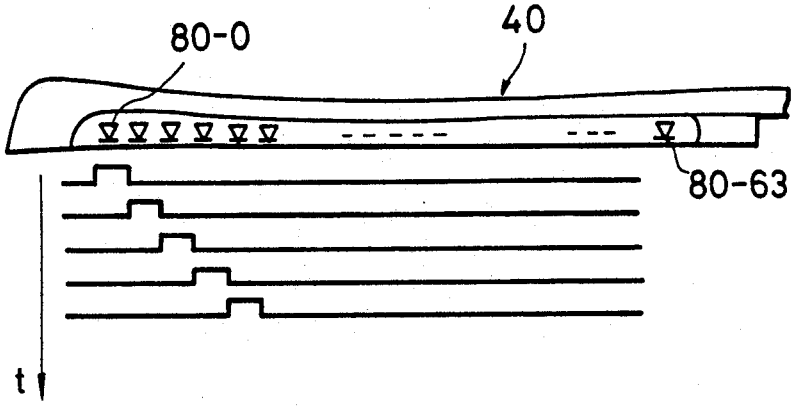
FIGS. 11A to 11C illustrate another example of the bow speed detection circuit, wherein 11A is an illustration of a bow achieving light emission in time sharing.
Figure 11B:
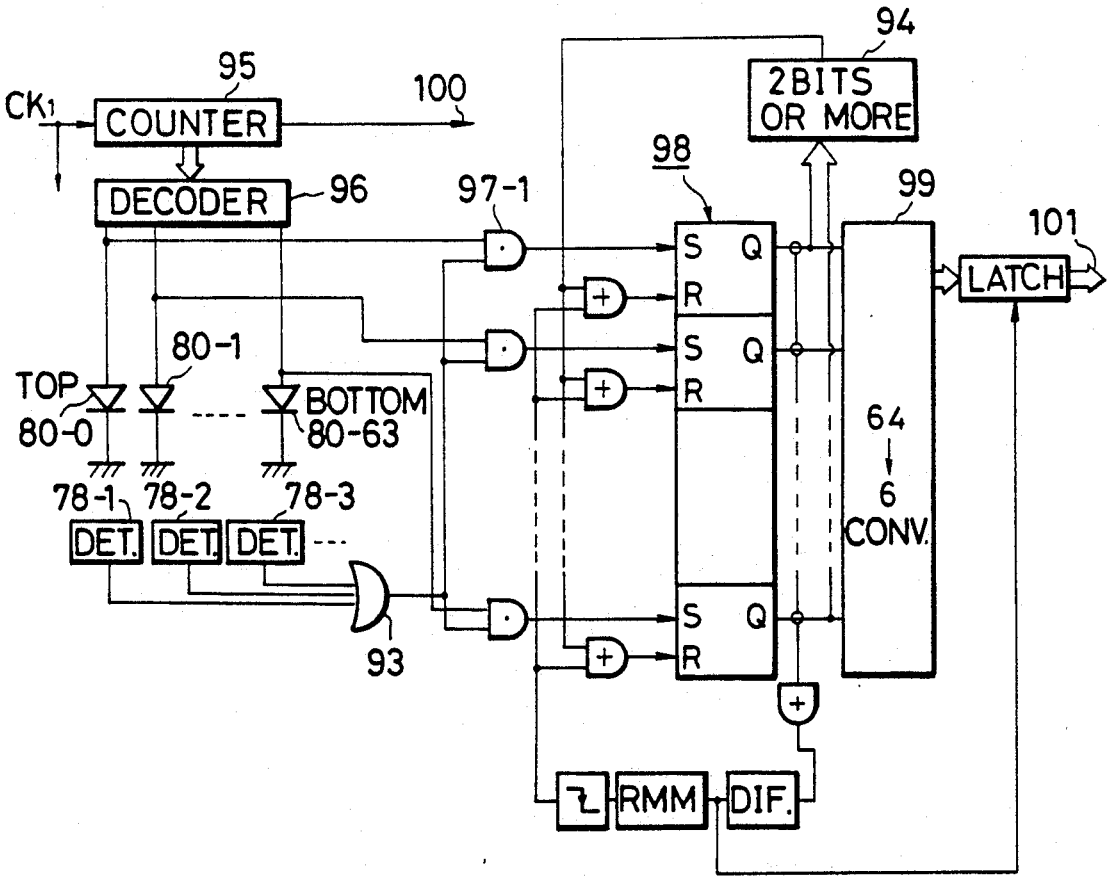
Figure 11C:
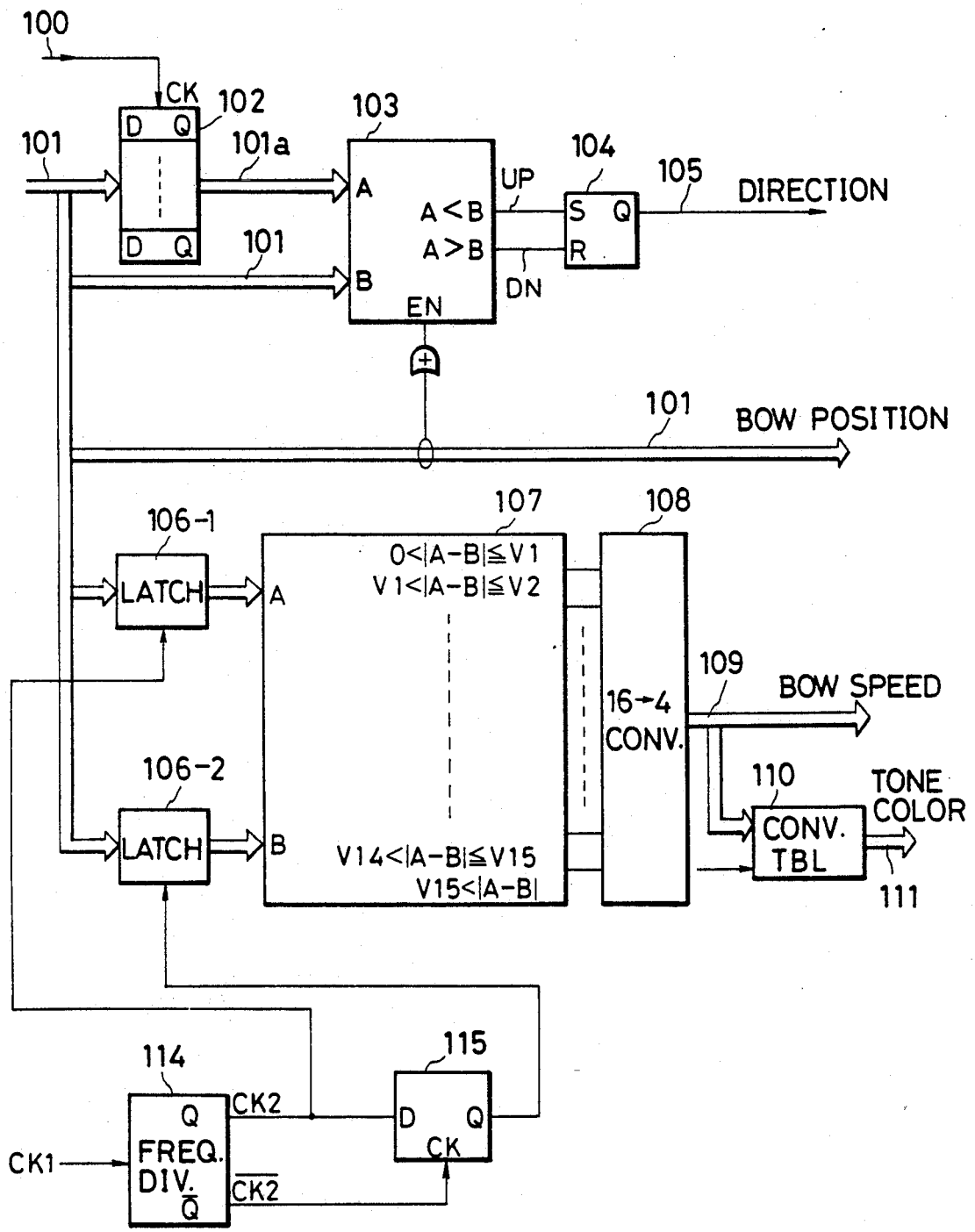

FIGS. 11A, 11B and 11C show an example a bow speed detection circuit employing time sharing.

FIG. 11A conceptually shows lights emitted from a bow 40. In the string rubbing surface of the bow 40 corresponding to hairs, 64 LEDs, for example, are alignedly embedded in one dimension. These LEDs are existed in a time sharing fashion. For example, 64 LED's are successively exited to emit lights with a trigger pulse signal of 3.2 MHz. At the 65-th pulse, the first LED is again excited to continue the successive light emission by the 64 LEDs.

In the figure, square pulses represent emitted lights from the LEDs. As the lapse of time, the LED which emits light is successively shifted rightward. In this way, successive pulses are divided into groups, each of 64 pulses, and 64 LED are successively excited to emit light in each group, in time sharing. Therefore, only one LED emits a light at one time. When detection is made which LED has emitted the detected light, it can be known that from what part of the bow the light has been emitted. By taking synchronism between the emitted light pulses and the detection of the light, it can be known that from what part of the bow the light has been emitted.

An example of the circuit for measuring such light pulses is shown in FIGS. 11B and 11C. In FIG. 11B, a clock signal CK1 having a higher frequency than 640 Hz, for example 1 MHz or 3.2 MHz is supplied to a counter 95 to count the number of pulses. The counted number of the pulses is decoded in a decoder 96 to form a signal of modulus 64, to successively emit lights from 64 LEDs 80-0 to 80-63. Light reception signals from light receiving elements 78-1, 78-2, . . . which timely receives the lights emitted from these LEDs are added in an OR circuit 93. The reason why a plurality of light receiving elements are provided is to enable the detection of a movement of the bow 40 in a certain wide area. The light reception signal from the OR circuit 93 and the pulse signal supplied from the decoder output are multiplied in AND circuits 97-*i* corresponding to the respective light emitting diodes 80-*i*. Namely, when the first LED 80-D triggered to emit light and a light reception signal is obtained from any of the light receiving elements, the AND circuit 97-1 supplies an output to the first flip-flop in the flip-flop train 98, to register that the light emission from the first LED is detected. Similarly, when the light emission from the n-th LED is detected in any light receiving element, the n-th flip-flop in the flip-flop train 98 is set.

When any of the light receiving elements 78-*i* receives a light at a timing when a LED 80-*i* emits light, the associated flip-flop FF 98-*i* is set. At the next timing, the next LED 80-(i+1) emits light. When this light is detected by some light receiving element, the next FF 98-(i+1) is set. Then, the outputs of the two FFs become simultaneously "1". This state is detected by a "2 bits or more" detection circuit 94 to reset the respective flip-flops in the FF train 98. Thus, flip-flops 98-*i* and the next flip-flops 98-(i+1) are reset. Here however, when the LED 80-(i+1) continuously emits light and this light is detected, the flip-flop 98-(i+1) is set again. Thus, the instantaneous position signal is formed. This position signal is converted into a 6-bit signal in a converter 99 and is sent to a latch circuit LATCH.

Further, as a measure of effecting reset in silent state, the respective flip-flops are reset when the next position signal from the AND circuit does not arrive in a period of about 0.02–0.3 sec. Namely, the OR logic of all the outputs of the flip-flops are differentiated in a differential circuit and the output is supplied to the reset inputs of the respective flip-flops through retriggerable monostable multivibrator RMM and a fall differentiator. After the Q output of the flip-flop, reset is done when the set time of the RMM has lapsed and the RMM recovers the original state.

Further, at a timing when the Q outputs of the flip-flops has changed from all "0" to any "1", latch is effected to a latch circuit on the righthand side of the 64 to 6 converter 99. During the time from the input of the reset signal to the setting, now detection state temporarilly occurs in spite of the bowing by a bow. The above construction avoids this influence.

In this way, it can be detected, simultaneously with the detection of the light pulse, what portion of the bow 40 is contacting the string rubbing portion 31 (see FIG. 2A). In the case when 64 LEDs are aligned as shown in FIG. 11A, 64 flip-flops will be aligned in the flip-flop train 98. According to the information what portion of the bow 40 is contacting the string rubbing portion 31, an output signal will be generated from a corresponding flip-flop. This 64 bits parallel signal is converted into a 6 bits signal in a converter circuit 99 and is supplied to the following state as a parallel 6 bits signal 101. Further, the output 100 of the counter 95 is similarly supplied to the following stage.

FIG. 11C shows a circuit to be connected in the following stage to the circuit of FIG. 11B. The 6 bits parallel signal 101 representing the contact position in the bow 40 is on one hand applied to a delay circuit 102 and on the other hand is applied also to a comparator 103, latches 106-1 and 106-2, and is also outputted directly as a position information signal. The delay circuit 102 receives the output 100 of the counter 95 and gives a delay of one pulse interval. The delayed output 101*a* of this delay circuit 102 and the original position signal 101 are compared in the comparator 103. If the signal 101 of one pulse before corresponds to a smaller number indicating a top portion of the bow, the bow is moving upwards. On the contrary, when the signal 101 of one pulse before corresponds to an LED of a larger number nearer to bottom portion and the following pulse corresponds to an LED of a smaller number nearer to the top end, the bow is moving downwards. In this way, the moving direction of the bow is discriminated to generate an up direction signal UP or a down direction signal DN. These direction signals are supplied to a flip-flop 104 which generates "1" when the bow is moving upwards and "0" when the bow is moving downwards.

When a key-on signal KON is needed in a usage circuit, an OR logic of the outputs UP and DN of the comparator circuit 103 may be used to form a KON signal.

The high frequency signal CK1 of, for example, 3.2 MHz is divided in a frequency divider 114 to generate a signal CK2 of a lower frequency of for example 10 Hz. Such a signal CK2 is supplied to the latch 106-1. The complementary signal CK2 to the signal CK2 is also generated. These signals CK2 and CK2 are supplied to a delay circuit 115 to form a signal which has delayed for one pulse interval. This delayed signal is supplied to the latch 106-2. Thus, a discrimination circuit 107 which receives the position signal 101 of the bow through the latches 106-1 and 106-2 inputs the information at that time and the information a certain period before. Therefore, when a difference between the two inputs A and B is taken, it can be known how far the bow 40 has moved in a predetermined time period. The detected movement quantity of the bow 40 is discriminated in 16 grades, if necessary, to generate an input in one of the 16 output lines. Also, the magnitude of shift can be expressed in a 16 bits signal representing 64K grades. The converter circuit 108 receiving these 16 output lines converted the 16 bits signal into binary 4 bits parallel signal and supplies it as a bow speed signal 109. The bow speed signal 109 is supplied also to a converter table 110 where a tone color signal 111 is formed by referring to a table. The conversion table 110 may have other inputs. In this way, signals representing the moving direction of the bhow, the bow position, bow speed, the tone color, etc. are derived from the circuit of FIGS. 11B and 11C.

Figure 12:
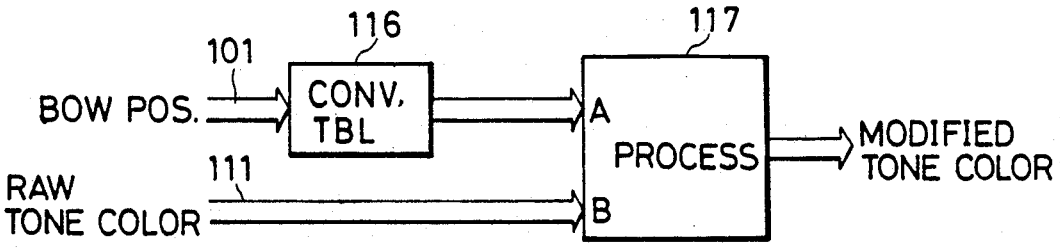
FIG. 12 is a circuit diagram showing a tone color signal circuit for generating a modified tone color signal.

FIG. 12 shows another example of the tone color signal circuit. Although a tone color signal is generated based on the bow speed signal 109 in the circuit FIG. 11C, a tone color signal is generated by further incorporating position information in the circuit of FIG. 12. Namely, a conversion table 116 receives the bow position signal 101 and converts the position signal into such a signal which for example takes high value in the middle bow position and low values in top and bottom bow positions. Such a converted signal and the raw tone color signal 111 which is formed on the basis of the bow speed signal in a circuit as shown in FIG. 11C are supplied to a processing circuit 117 where processing such as addition, multiplication, etc. are done to form a modified tone color signal 118. The string position at which the bow contacts may also be incorporated to modify the tone color.

The musical tone of a rubbed string instrument such as the voilin changes also on the bow pressure. For generating musical tones resembling to those of a natural musical instrument, it is preferable to utilize the bow pressure information. For detecting the bow pressure, it is preferable to detect the pressure on the main body side, e.g. by detecting a stress given by a bow in a string rubbing portion 31 as shown in FIG. 2A.

Figure 13A:
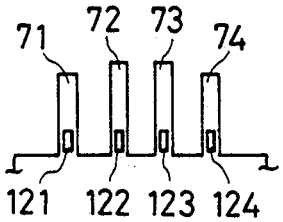
Figure 13B:
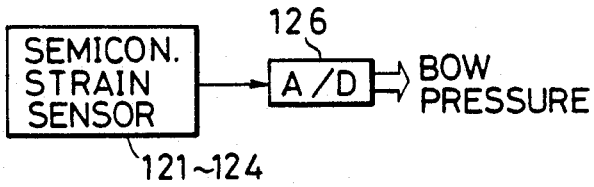

FIGS. 13A and 13B show an example of the bow pressure detection circuit. In FIG. 13A, semiconductor strain sensors 121, 122, 123, and 124 are embedded in the neighborhood of the root of the string corresponding members 71, 72, 73, and 74 of the string rubbing portion 31. When the slide plate 76 which is a hair corresponding portion of the bow 40 gives friction to any one of the string corresponding portions 71, 72, 73 and 74, the string corresponding portion 71, 72, 73 or 74 is deformed. The deformation is detected by the semiconductor strain sensor 121, 122, 123, or 124.

In FIG. 13B the detected output from the semiconductor strain sensor 121 to 124 is converted into a digital signal in an A/D converter 126 to form a bow pressure signal.

The semiconductor strain sensor as described before may be a semiconductor piezoelectric element utilizing the piezo resistance, or may be formed of such one in which conductive powder is dispersed in an insulating body formed of for example silicone rubber as is disclosed in Japanese Patent Laid-open Sho. 62-116229, or may be an FET type strain detecting integrated circuit in which a pressure sensitive portion is formed in the channel region of an FET as is disclosed in Japanese Utility Model Publication Sho. 57-47820, which are incorporated herein by reference.

Figure 14A:
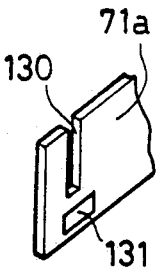
FIGS. 14A to 14C illustrate loading of a pressure sensors, and are perspective views showing three different loading modes.
Figure 14B:
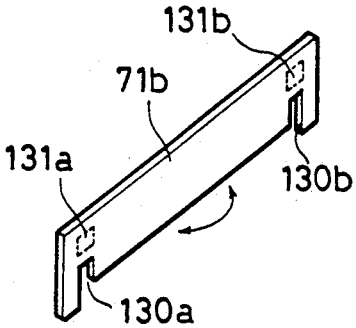
Figure 14C:
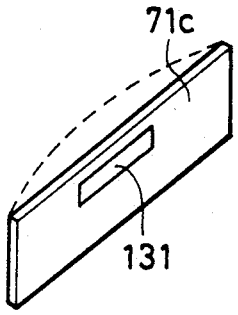

FIGS. 14A, 14B and 14C show examples of loading pressure sensors. In FIG. 14A, the string corresponding member **71*a* is provided with a cutout near the support portion to be easily rotatable by a bow pressure and strain sensor 131** is disposed at a narrowed portion.

In FIG. 14B cutouts **130*a* and 130*b* are formed at both ends of a string corresponding member 71*b*, and strain sensors 131*a* and 131*b*** are provided at the respective narrowed portions. The outputs from the two sensors are added to derive a pressure signal.

In FIG. 14C, the mounting of the string corresponding member **71*c* is changed. As shown in the figure, the string corresponding member 71*c* is held at the both end portions. Therefore, when the string corresponding member 71*c* is rubbed with the bow, the string corresponding member 71*c* is deformed in such a way that the central portion swings horizontally in the figure. A strain sensor 131** is disposed at a portion of this large deformation.

Several examples of loading strain sensors are shown hereinabove, they are not limitative. Any loading and any detection can be employed provided that a force acting upon the abutment or contact the bow can be detected.

Further, instead of detecting the pressure, change in the direction of pressure may be detected.

As is described above, by obtaining the pitch information from the fingering position on the fingerboard and also obtaining bow speed signal, the bow position signal and the bow pressure signal from the movement of the bow, basic parameters for forming the musical tone of the rubbed string instrument can be obtained.

Further, by providing a vibrato switch on the neck, even a beginner player can easily perform such a special musical effect unique to the rubbed string instruments such as the violin. Since this vibrato switch gives different effect from the performance of a natural musical instrument, it is preferably arranged to be functionally removable for those players having a high level of technique.

Also, it is difficult for beginner player of the violin to accurately control the pressure given to a string by the bow. When a top portion of the bow is contacting a string, the distance between the string and the handle portion where the player holds the bow becomes large. When the musical tone to be generated should be controlled in correspondence to the bow pressure, performance rich in musical taste becomes difficult for a beginner player. Here, it is possible in an electronic musical instrument to provide various functions electrically which are not provided for natural musical instrument. For example, a beginner player may form a bow speed signal by the movement of the bow and a bow pressure signal by grasping a bow pressure input device provided at the handle portion of the bow.

Figure 15:
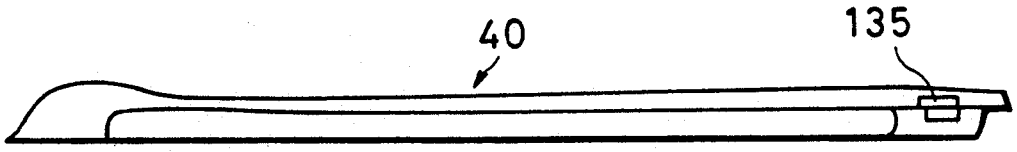
FIG. 15 is a schematic side view of a bow provided with a holding pressure sensor.

FIG. 15 illustrates an example where a grasping pressure sensor 135 is provided at the handle portion of the bow 40.

When a player grasps the grasping pressure sensor 135, the sensor 135 detects the pressure and generates a signal which can be utilized for tone signal formation as a bow pressure signal.

Although description has been made on the case where the bow pressure is inputted from a grasping pressure sensor provided at the handle portion, another information may be inputted from this grasping pressure sensor. For example, it can be utilized to add vibrato effect, etc. This sensor can also be utilized to exhibit various functions such as tenuto, staccato, pizzicato, etc. as well as vibrato.

There may be cases when it is difficult to input pressure information even from the grasping pressure sensor provided in the bow. In such a case, the grasping pressure sensor may be released its function and a constant bow pressure may be set to generate a tone signal.

Figure 16:
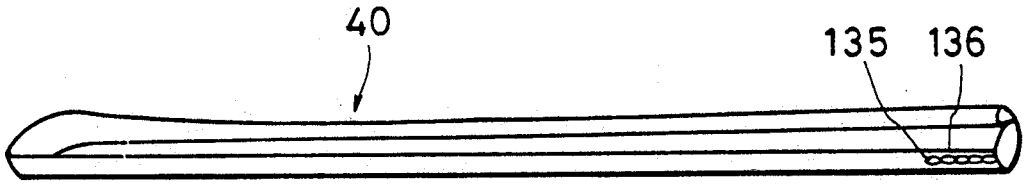
FIG. 16 is a schematic side view of a bow provided with performance mode change-over switches.

FIG. 16 shows a case where a pressure sensor and a plurality of switches are provided in the handle portion of the bow 40 to utilize them as a bow pressure inputting device and performance mode selection switches. There may be provided several kinds of bow pressure change-over switches to enable selection of settable bow pressures. The number of switches may be arbitrarily selected. When the bow pressure is inputted through the pressure sensor in the string rubbing portion or the grasping pressure sensor in the handle portion of the bow, the bow pressure selection switches are released. At this time, these switches can be utilized for other purposes. Of course the number of switches may be increased to assign a single function to one switch. The performance mode selection switches may be assigned to various special performance effects such as vibrato, tremoro, tenuto, staccato, etc.

Figure 17:
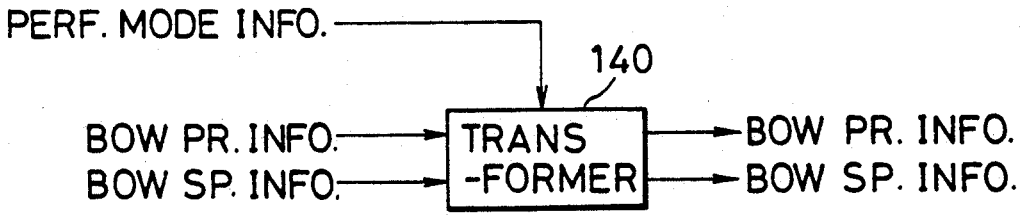
FIG. 17 is a circuit diagram of a transformer circuit for transforming a bow pressure signal and bow speed signal based on performance mode change-over information.

FIG. 17 shows a transformer circuit for transforming the bow pressure and the bow speed by the performance mode selection information. Based on the performance mode selection information inputted from the performance mode selection switch, one of the transformation modes prepared in the transformer 140 is selected. The bow pressure information and the bow speed information are applied to the transformer 140 and a predetermined transformation according to one selected transformation mode is done based on these information to supply the furnished bow pressure information and the furnished bow speed information.

Generally, electronic keyboard instrument widely employs temperament to enable easy transposition. However, for example, there are cases where it is desired to be able to select, the temperament or just intonation, or to effect transposition according to the peace or to employ different tonality in one or two strings among the four strings of the instrument. There exist various difficulties in realizing such versatility in an electronic keyboard musical instrument, but in the instruments as described above, it is possible.

For example, tuning volumes (variable resistance elements) may be provided for the respective strings in the peg portion where there is no need to physically stretch strings. If these volumes effect tunings all the time, it may be troublesome to adjust tuning of the respective strings. Therefore, the tuning function by the volume elements may be arranged to be releasable. For example, there is provided a reset switch which returns the tuning condition to the original fifth degree interval. There exists a width of several cents in the basic pitches, and therefore it is preferable to prepare a selection switch or switches from 435 Hz to 445 Hz or the like. For effecting tuning with respect to another or other instruments, it is preferable to provide a function to parallelly transposing the four strings simultaneously. Further, for enabling performances as described before, there may be provided transposition switches and other switches in the peg portion 22 as shown in FIGS. 2A and 2B.

Figure 18:
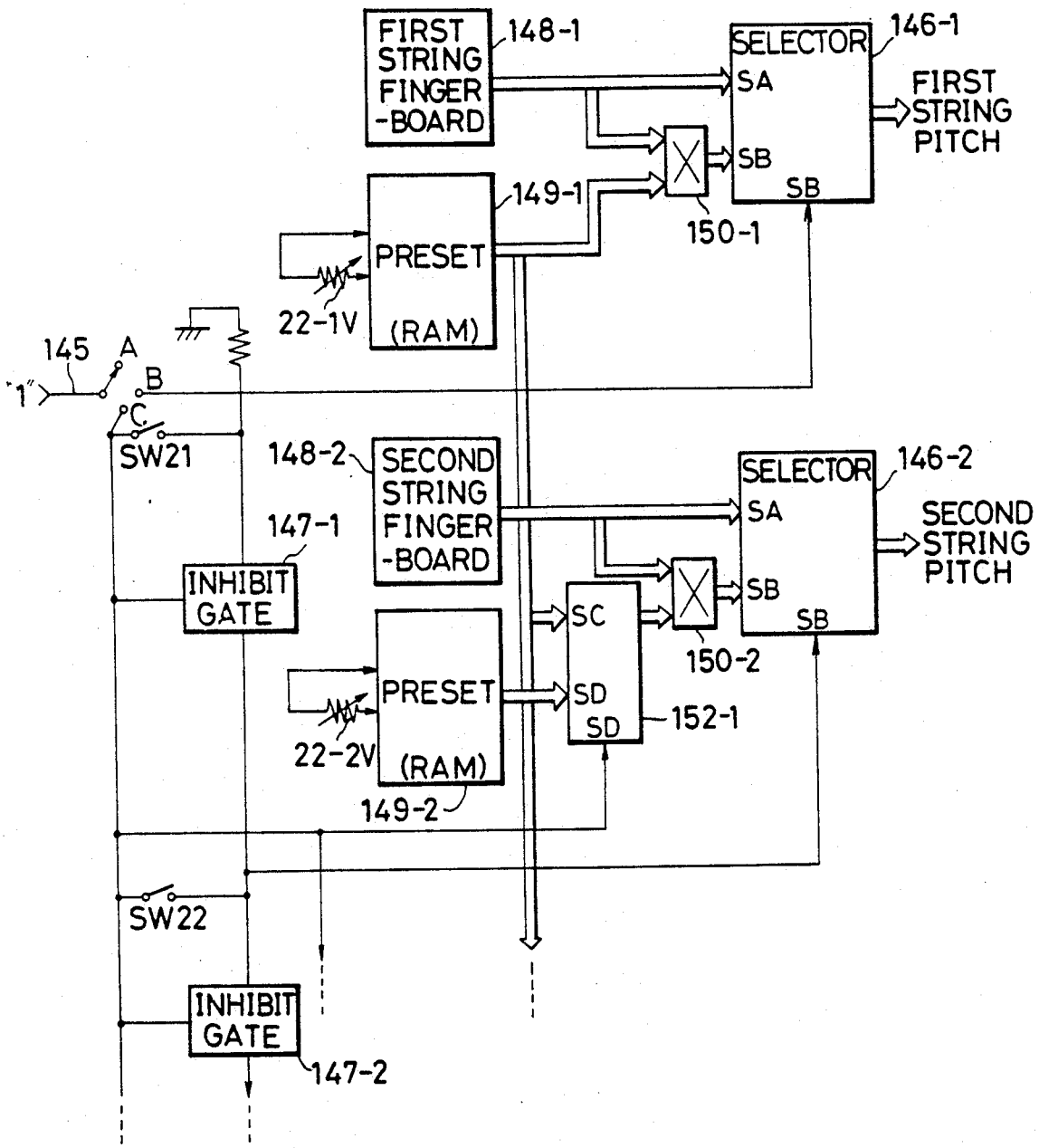
FIG. 18 is a block diagram showing an example of a transportation circuit.

FIG. 18 shows a transposition circuit including a transposition switch. This circuit is featured by capacity of arbitrarily selecting a tonality or a temperament.

Two-inputs selector 146-1 for the first string selects either of plural-bits inputs SA or SB depending on whether the signal at the select signal terminal is "0"or 37 1", and supplies it to the output. The input terminal SA receives the output from a first fingerboard 148-1 for the first string. The input terminal SB receives the output from a multiplier 150-1. The multiplier 150-1 receives the output from first string fingerboard 148-1 and the output of a preset RAM 149-1 which adjusts transposition or pitch, and generates the product thereof. Thus, the input SA provides the standard pitch and the input B provides a modified pitch.

In the circuits for the second, third and the forth strings, two-inputs selectors 152-1, 152-2 and 152-3 are further provided between preset RAMs 149-2, 149-3, and 149-4 and multipliers 150-2, 150-3, and 150-4. The two-inputs selectors 152-1, 152-2, or 152-3 selects either of the output of the preset RAM 149-1 or the output of the preset RAM 149-2, 149-3, or 149-4 and supplies it to the multiplier 150-2, 150-3, or 150-4. For effecting transposition, the rate of change in the pitch may be the same for the four strings. In such cases, the output of the preset RAM 149-1 is used commonly for the four strings. The preset RAMs 149-2, 149-3, and 149-4 can modulate the pitches of the second, third and fourth strings independently.

The selection of these selectors is made by a mode selection switch 145. The mode selection switch 145 has three fixed contact A, B, and C. Among these contacts, the contact A shown above is floated.

First, when the mode selection switch 145 is set to the floated contact A, the select signal terminal of the respective selectors 146-1, 146-2, . . . receives "0", and select the plural-bits output SA from the first string fingerboard 148-1, the second string fingerboard 148-2, . . . , which correspond to the pitch designating device shown in FIGS. 4A to 4C. Namely, a resistance or a voltage determined by the position depressed by a finger in the resistive member 51 as shown in FIG. 4A is outputted. The output pattern of this resistance or the voltage is tuned, for example, in the temperament.

Next, when the mode selection switch 145 is set to the contact B shown in the middle portion, signal "1" is inputted to the select signal terminals of the respective selectors 146-1, 146-2, . . . to select the plural-bits input SB. The input SB of the selector 146-1 is applied with a multiplied signal of the pitch modulating data and the output of the fingerboard 148-1, from the multiplier 150-1. The pitch modulating data if formed by coarsely adjusting the pitch by the transposition or pitch adjuster 149-1 and then finely adjusting the pitch by a volume 22-IV of the digital switch type.

Select signal terminals of the selectors 152-1, 152-2 and 152-3 receive "0" and select the input SC (i.e. the output of the preset RAM 149-1). Therefore, the multipliers 150-2, 150-3, and 150-4 supplies the product of the output of the fingerboard 148-2, 148-3, 148-4 and the outputs of the preset RAM 149-1 to the input SB of the selectors 146-2, 146-3, and 146-4.

When the mode selection switch 145 is set to the contact C. first an inhibit gate signal is sent to bidirectional inhibit gates 147-1, 147-2, . . . to inhibit the transmission of the signals. Further, signal "1" is supplied to the select signal terminals of the two-inputs selector 152-1, 152-2 and 152-3 to select the inputs SD. Namely, the output of the preset RAMs 149-2, 149-3, and 149-4 for the respective strings are inputted to the associated multipliers 150-2, 150-3, and 150-4. When one or more of the switches SW21, SW22, . . . are turned on, signal "1" is inputted to the select signal terminals of the corresponding selectors 146-1, 146-2, . . . , to select the input SB. Namely, the product of the output of the fingerboard 148-1, 148-2, . . . and the output of the preset RAM 149-1, 149-2 for the associated string is selected. In this way, the pitches for the respective strings can be set independently.

In this way, the contact A may be assigned to, for example, the temperament, the contact B may be assigned to the so-called transposition of all strings shifting, and the contact C may be assigned to independent and arbitrary tuning of the respective strings. It is also possible to employ the just intonation, Pythagoras temperament. Neidhart temperament, and other tunings such as one in which the fourth, the third, the second and the first strings have the pitches (G, D, A, E) or (A, D, A, E) in the open state. In this way, by adjusting the transposition switch or the tuning volumes provided, for example, the peg portion, tunings similar to that of the natural musical instrument or transposition by one touch action can be performed. The bowing information may include the distance of the bow from the bridge or the degree of jumping of the bow, etc. as well as those information described above. For example, the bowing information due to the light signals and the information on the bow movement by proximity switches may be used simultaneously.

Description has been made on the cases where performance is done according to the exterior appearance of the rubbed string instrument, the musical tones of other kinds of instruments may be generated as well as the musical tones of the string instruments which are performed by using a bow. For example, the performance mode may be changed by a switch and the string is tapped by the bow or the bow is moved relative to the bridge in touchless fashion, to generate musical tones of rhythm instruments, etc. For example, musical tones of bongo, tamtam, gong, timpany, etc. may be generated. For example, sound of gong has relatively long sustain from the rise of the tone to the termination of the tone. When the bowing information is used as an input signal, various expressions can be made. For example, the bow speed information and the touch information may be incorporated into the tone color information. Further, the touch information may be obtained from the pressure sensor or sensors provided the handle of the bow and at the string corresponding portion, and the bow speed information is used as a tone color modifying information.

Figure 19:
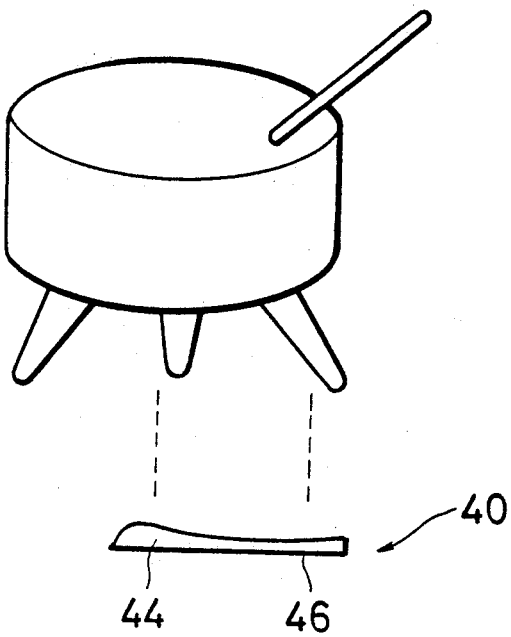
FIG. 19 is a schematic diagram for illustrating a percussion instrument mode.

As shown in FIG. 19, the position information of the bow 40, such as top bow 44 or bottom bow 46 may be associated with the position in the skin of a drum tapped by a stick, for example, the radial distance from the center to the edge in the drum to control the tone color parameter.

Figure 20:
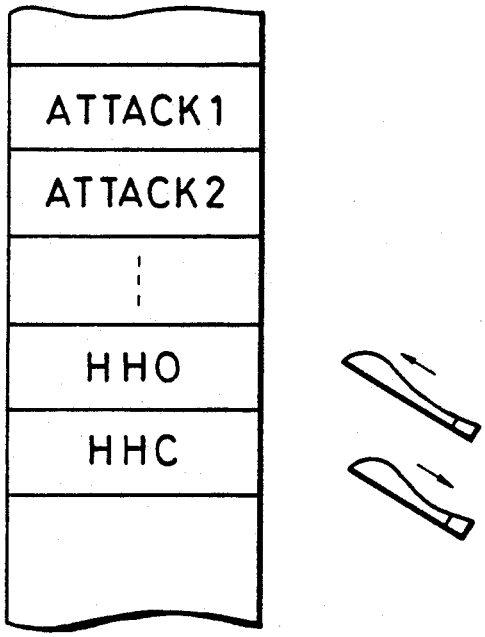
FIG. 20 is a conceptual diagram for illustrating a percussion instrument mode of a waveform memory type.

In the case of a percussion tone signal generating circuit of the waveform memory type as shown in FIG. 20, the waveform of only the attack portion may be selected and changed.

Also, in such a case as the high hat symbals where there is directional movement, the information on the directional movement of the bow may be used for selecting the waveform memory. For example, by the upper movement UP, the address HHO where high hat symbol is raised up is read out. Similarly, by the downward movement DN of the bow, the address HHC where the high hat symbal is brought down is read out. In this way, different memory areas may be selectively read out. In this case, the UP/DN bit may be used to select the upper bit of the memory address.

The pitch information may be fixed for the respective strings. In the case of rhythm instrument having several pitches such as tamtam, the pitch of the tone may be selected by the finger position on the fingerboard.

In such application to the rhythm musical instruments, it is not always necessary to touch the bow to the string corresponding portion and moving the bow while touching the string corresponding portion. Some kind of input signal may be obtained by relatively moving the bow in the neighborhood of the string corresponding portion.

Although description has been made on various embodiments, the present invention is not limited thereto. For example, various modifications, substitutions, alteration, combinations, etc. are possible within the scope and the spirit of the invention.

I claim:

1. A tone signal controlling apparatus for an instrument capable of electronically simulating a stringed instrument, comprising:

a body having a string corresponding portion;

a movable operation tool separable from the body and adapted to be held by a player and to be moved in facing relation to said string corresponding portion;

relative motion detecting means for detecting relative motion of said string corresponding portion and said movable operation tool and for generating a detection signal representing a manner of the relative motion; and tone signal controlling means for controlling an element of a tone signal to be generated, based on said detection signal.

2. A tone signal controlling apparatus according to claim 1, further comprising:

mode selection means provided near a holding portion of said movable operation tool, for generating a selection signal of the performance mode; and said tone signal controlling means for controlling an element of a tone signal to be generated, based on said detection signal and said selection signal.

3. A tone signal controlling apparatus according to claim 1, further comprising:

a holding pressure sensor provided at a holding portion of said movable operation tool, for generating a holding pressure signal corresponding to the pressure holding the holding portion; and said tone signal controlling means for controlling an element of a tone signal to be generated, based on said detection signal and said holding pressure signal.

4. A tone signal controlling apparatus according to claim 1, further comprising:

a pressure sensor provided in said string corresponding portion for generating, when said movable operation tool is depressed to the string corresponding portion of said body, a pressure detecting signal corresponding to the pressure applied to said body; and said tone signal controlling means for controlling an element of a tone signal to be generated, based on said detection signal and said pressure detecting signal.

5. A tone signal controlling apparatus comprising:

a body having a neck and a string corresponding portion;

a movable operation tool to be held by a player, capable of being disposed in facing relation to and moved relative to the string corresponding portion of said body, to achieve performance;

relative motion detecting means for detecting relative motion of said string corresponding portion and said movable operation tool, and for generating a detection signal representing a manner of the relative motion;

the pitch designating means provided in the front side of said neck, for designating a tone pitch of a musical tone to be generated;

tone element controlling means provided in the back side of said neck, for controlling an element of a tone signal to be generated, except the tone pitch; and tone signal controlling means for controlling an element of a tone signal to be generated, based on said detection signal and outputs of said tone pitch designating means and said tone element controlling means.

6. A tone signal controlling apparatus according to claim 5, wherein said tone element controlling means controls an effect of fingering.

7. A tone signal controlling apparatus according to claim 5, wherein said tone element controlling means controls an effect of bowing.

8. A tone signal controlling apparatus comprising:

a body having a neck and a string corresponding portion;

a movable operation tool to be held by a player, disposed in facing relation to and moved relative to the string corresponding portion of said body, to achievce performance;

mutual motion detecting means for detecting mutual motion of said string corresponding portion and said movable operation tool, and for generating a detection signal representing a manner of the mutual motion;

tone pitch designating means provided in the front side of said neck, for designating a tone pitch of a musical tone to be generated;

pitch tuning means provided at an end of said neck and having a variable element, for generating a pitch tuning quantity which modulates the pitch of an tone signal to be generated, in correspondence to a value of said variable element; and tone signal controlling means for controlling an element of a tone signal to be generated, based on said detection signal, and outputs of said tone pitch designating means and said pitch tuning means.

9. A tone signal controlling apparatus for an instrument capable of electronically simulating a stringed instrument, comprising:

a body having a string corresponding portion including a pressure sensitive electronic means for designating a pitch;

a movable operation tool separable from the body and adapted to be held by a player and to be moved in facing relation to said string corresponding portion;

relative motion detecting means for detecting relative motion of said string corresponding portion and said movable operation tool and for generating an electronic detection signal representing at least one of the pressure, angle, direction, and speed components of the relative motion; and tone signal controlling means for controllinmg an element of a tone signal to be generated, based on said detection signal and said designated pitch.

* * * * *